US009984636B2

(12) United States Patent
Shin et al.

(10) Patent No.: US 9,984,636 B2
(45) Date of Patent: May 29, 2018

(54) DISPLAY DEVICE AND DRIVING METHOD THEREOF

(71) Applicant: Samsung Display Co., Ltd., Yongin-si, Gyeonggi-Do (KR)

(72) Inventors: Donghwa Shin, Yongin-si (KR); Taejin Kim, Hwaseong-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 129 days.

(21) Appl. No.: 14/937,581

(22) Filed: Nov. 10, 2015

(65) Prior Publication Data

US 2016/0189642 A1 Jun. 30, 2016

(30) Foreign Application Priority Data

Dec. 30, 2014 (KR) ..... 10-2014-0194163

(51) Int. Cl.
*G09G 3/36* (2006.01)

(52) U.S. Cl.
CPC ..... *G09G 3/3614* (2013.01); *G09G 3/3648* (2013.01); *G09G 3/3655* (2013.01); *G09G 2300/0426* (2013.01); *G09G 2300/0452* (2013.01)

(58) Field of Classification Search
CPC .. G09G 3/3614; G09G 3/3648; G09G 3/3655; G09G 2300/0426; G09G 2300/0452; G09G 3/2055; G09G 3/3607
See application file for complete search history.

(56) References Cited

U.S. PATENT DOCUMENTS

| | | | | |
|---|---|---|---|---|
| 6,552,706 | B1 * | 4/2003 | Ikeda | G09G 3/3607 345/100 |
| 7,430,375 | B2 | 9/2008 | Ikeda | |
| 2005/0190138 | A1 | 9/2005 | Jung | |
| 2008/0238911 | A1 * | 10/2008 | Chung | G09G 3/2055 345/214 |
| 2012/0299895 | A1 * | 11/2012 | Lin | G09G 3/3655 345/211 |
| 2016/0055808 | A1 * | 2/2016 | Guo | G09G 3/3607 345/694 |

FOREIGN PATENT DOCUMENTS

| | | |
|---|---|---|
| KR | 1020060078753 | 7/2006 |
| KR | 1020070001507 | 1/2007 |
| KR | 1020080040952 | 5/2008 |
| KR | 1020080051916 | 6/2008 |
| KR | 20140011676 A | 1/2014 |

* cited by examiner

*Primary Examiner* — Richard Hong
(74) *Attorney, Agent, or Firm* — Innovation Counsel LLP

(57) ABSTRACT

Provided if a display device including a liquid crystal panel, a common voltage generator configured to generate a common voltage, and a common voltage compensator. The liquid crystal panel includes gate lines, data lines, pixels, and a common electrode. The pixels include first pixels and second pixels. The first pixels and the second pixels are respectively disposed in pixel rows adjacent to each other, respectively constitute different columns, are connected to the same gate line, display the same color, and receive data voltages having different polarities. When a boundary of a pattern included in image data, extending in a first direction, lies between the first pixels and the second pixels, the common voltage compensator is configured to compensate the common voltage.

18 Claims, 22 Drawing Sheets

DISPLAY DEVICE AND DRIVING METHOD THEREOF

CROSS-REFERENCE TO RELATED APPLICATIONS

This U.S. non-provisional patent application claims priority under 35 U.S.C. § 119 of Korean Patent Application No. 10-2014-0194163, filed on Dec. 30, 2014, the entire contents of which are hereby incorporated by reference.

BACKGROUND

The present disclosure herein relates to a display device and a driving method thereof, and more particularly, to a liquid crystal display device using an inversion driving method and a driving method thereof.

A liquid crystal device generates electric fields in a liquid crystal layer disposed between two substrates to change the arrangement of liquid crystal molecules, thereby controlling transmittance of incident light to display images.

Driving methods of a liquid crystal device include a line inversion method, a column inversion method, a dot inversion method, and the like according to the phase of data voltages applied to data lines. In the line inversion method, image data is applied to data lines in such a way that the phase of the image data is inverted at every pixel row. In the column inversion method, image data is applied to data lines in such a way that the phase of the image data is inverted at every pixel column. In the dot inversion method, image data is applied to data lines in such a way that the phase of the image data is inverted at every pixel row and every pixel column.

Meanwhile, display devices generally express colors using three primary colors of red blue, and green. Therefore, display panels include respective sub-pixels corresponding to red, blue, and green. Recently, display devices displaying colors using red, blue, green, and primary colors have been suggested. The primary colors are colors other than red, blue, and green. The primary colors may be for example, magenta, cyan, yellow or white, and may be two or more colors. Furthermore, technologies including red, blue, green, and white sub pixels have been suggested to increase luminance of display images. Red, blue, and green image signals which are externally provided should be converted into red, blue, green, and white data signals to be provided to a display panel.

SUMMARY

The present disclosure provides a display device capable of preventing one line crosstalk and a method for processing data thereof.

Display devices according to embodiments of the inventive concept may include a liquid crystal panel, a gate driver, a data driver, a liming controller, a common voltage generator, and a common voltage compensator.

The liquid crystal panel may include a plurality of gate lines, a plurality of data lines, a plurality of pixels, and a common electrode.

The plurality of gate lines may extend in a first direction. The data lines may extend in a second direction interesting with the first direction. The plurality of pixels may be connected to the gate lines and the data lines.

The pixels may include pixels in an h-th (h is a natural number) row and pixels in an (h+1)-th row with a (k+1)-th (k is a natural number) gate line of the gate lines disposed therebetween, wherein the pixels in the h-th row and the pixels in the (h+1)-th row are adjacent to each other in the second direction.

First pixels which display a first color and are connected to the (k+1)-th gate line among the pixels in the h-th row and second pixels which display the first color and are connected to the (k+1)-th gate line among the pixels in the (h+1)-th row, may be spaced from each other in the first direction and may receive data voltages having different polarities.

The gate driver may be configured to provide the gate lines with gate signals. The data driver may be configured to provide the data lines with data voltages. The timing controller may be configured to receive control signals and image data, provide the gate driver with a gate control signal, and provide the data driver with a data control signal.

The common voltage generator may be configured to generate a common voltage to be applied to the common electrode. The common voltage compensator may be configured to compensate the common voltage before a (k+1)-th gate signal is applied to the (k+1)-th gate line, in the case where a boundary of a pattern included in the image data, extending in the first direction, lies between the first pixels and the second pixels.

The common voltage compensator may be configured to add, to the common voltage, a first compensating voltage having polarity opposite to that of data voltages applied to at least a portion of the first pixels when the pattern is displayed in at least a portion of the first pixels and is not displayed in the second pixels. The common voltage compensator may be configured to add, to the common voltage, a second compensating voltage having polarity opposite to that of data voltages applied to at least a portion of the second pixels when the pattern is displayed in at least a portion of the second pixels and is not displayed in the first pixels.

The common voltage compensator may include a pattern analyzer, a compensating section determiner, and a compensating voltage determiner. The pattern analyzer may be configured to analyze the pattern included in the image data to determine whether the boundary of the pattern, extending in the first direction, lies between the first pixels and the second pixels.

The compensating section determiner may be configured to determine a compensating section in which the common voltage is to be compensated when the boundary of the pattern, extending in the first direction, lies between the first pixels and the second pixels.

The compensating voltage determiner may be configured to determine the magnitude and polarity of a compensating voltage to be compensated to the common voltage when the boundary of the pattern, extending in the first direction, lies between the first pixels and the second pixels.

The compensating section determiner may be configured to set the compensating section to be within a horizontal blank section between a k-th horizontal scanning section in which a k-th gate signal is applied to a k-th gate line and a (k+1)-th horizontal scanning section in which the (k+1)-th gate signal is applied to the (k+1)-th gate line.

The compensating section determiner may be configured to set the compensating section to be a section from a first point of time within the horizontal blank section to a point of time at which the (k+1)-th horizontal scanning section starts.

The first point of time may be set to be a point of time at which data voltages are applied to the first pixels which display the pattern or a point of time at which data voltages are applied to the second pixels which display the pattern.

The compensating voltage determiner may be configured to determine the magnitude of the compensating voltage, based on the number of pixels displaying the pattern among the first pixels and the second pixels and the level of data voltages applied to the pixels displaying the pattern.

The compensating voltage determiner may be configured to set the polarity of the compensating voltage to be opposite to that of data voltage applied to at least a portion of the first pixels when the pattern is displayed in at least a portion of the first pixels and is not displayed at the second pixels. The compensating voltage determiner may be configured to set the polarity of the compensating voltage to be opposite to that of data voltages applied to at least a portion of the second pixels when the pattern is displayed in at least a portion of the second pixels and is not displayed at the first pixels.

The first color may be any one of red, green, blue, or white.

The pixels in the h-th row may include first and second pixel groups which are sequentially disposed in the first direction, and the pixels in the (h+1)-th row may include third and fourth pixel groups which are sequentially disposed in the first direction. Each of the first to fourth pixel groups may include an even number of pixels.

Each of the first and fourth pixel groups may include two pixels among red, green, blue, and white pixels. Each of the second and third pixel groups may include the remaining two pixels among the red, green, blue, and white pixels.

The second pixels may be included in pixels in a (2u+1)-th (u is a natural number) column when the first pixels are included in pixels in a (2u−1)-th column. The second pixels may be included in pixels in a (2u+2)-th column when the first pixels are included in pixels in a 2u-th column.

Two pixels which are adjacent to each other in the second direction with a 2k-th gate line disposed therebetween, among pixels in a (2u−1)-th (u is a natural number) column, may share the 2k-th gate line to be connected to each other. Two pixels which are adjacent to each other in the second direction with a (2k−1)-th gate line disposed therebetween, among pixels in a 2u-th column, may share the (2k−1)-th gate line to be connected to each other.

Two pixels which are adjacent to each other in the second direction with a (2k−1)-th gate line disposed therebetween, among pixels in a (2u−1)-th (u is a natural number) column, may share the (2k−1)-th gate line to be connected to each other. Two pixels which are adjacent to each other in the second direction with a 2k-th gate line disposed therebetween, among pixels in a 2u-th column, may share the 2k-th gate line to be connected to each other.

Pixels in a u-th (u is a natural number) column, which are disposed between a j-th (j is a natural number) data line and a (j+1)-th data line of the data lines, may be alternately connected to the j-th data line and the (j+1)-th data line by every at least one pixel.

The polarities of data voltages applied to the data lines may be inversed by every at least one data line.

The pixels in the h-th row, which are disposed between a k-th gate line and the (k+1)-th gate line of the gate lines, may be alternately connected to the k-th gate line and the (k+1)-th gate line by every at least one pixel.

A driving method of a display device according to an embodiment of the inventive concept may include: providing a liquid crystal panel which includes a plurality of gate lines extending in a first direction, a plurality of data lines extending in a second direction intersecting with the first direction, a plurality of pixels connected to the gate lines and the data lines, and a common electrode, wherein the pixels includes pixels in an h-th (h is a natural number) row and pixels in an (h+1)-th row with a (k+1)-th (k is a natural number) gate line of the gate lines disposed therebetween, wherein the pixels in the h-th row and the pixels in the (h+1)-th row are adjacent to each other in the second direction, and first pixels which display a first color and are connected to the (k+1)-th gate line among the pixels in the h-th row, and second pixels which display the first color and are connected to the (k+1)-th gate line among the pixels in the (h+1)-th row, may be spaced from each other in the first direction and may receive data voltages having different polarities; generating a common voltage to be applied to the common electrode; determining whether a boundary of a pattern included in image data input, extending in the first direction, lies between the first pixels and the second pixels; and compensating the common voltage before a (k+1)-th gate signal is applied to the (k+1)-th gate line, in the case where the boundary of the pattern included in the image data, extending in the first direction, lies between the first pixels and the second pixels.

The compensating of the common voltage may include: determining the magnitude of a compensating voltage to be compensated to the common voltage; determining the polarity of the compensating voltage; and determining a compensating section in which the common voltage is to be compensated.

The compensating section may be set to be within a horizontal blank section between a k-th horizontal scanning section in which a k-th gate signal is applied to a k-th gate line and a (k+1)-th horizontal scanning section in which the (k+1)-th gate signal is applied to the (k+1)-th gate line.

BRIEF DESCRIPTION OF THE DRAWINGS

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION OF THE EMBODIMENTS

Figure 1:
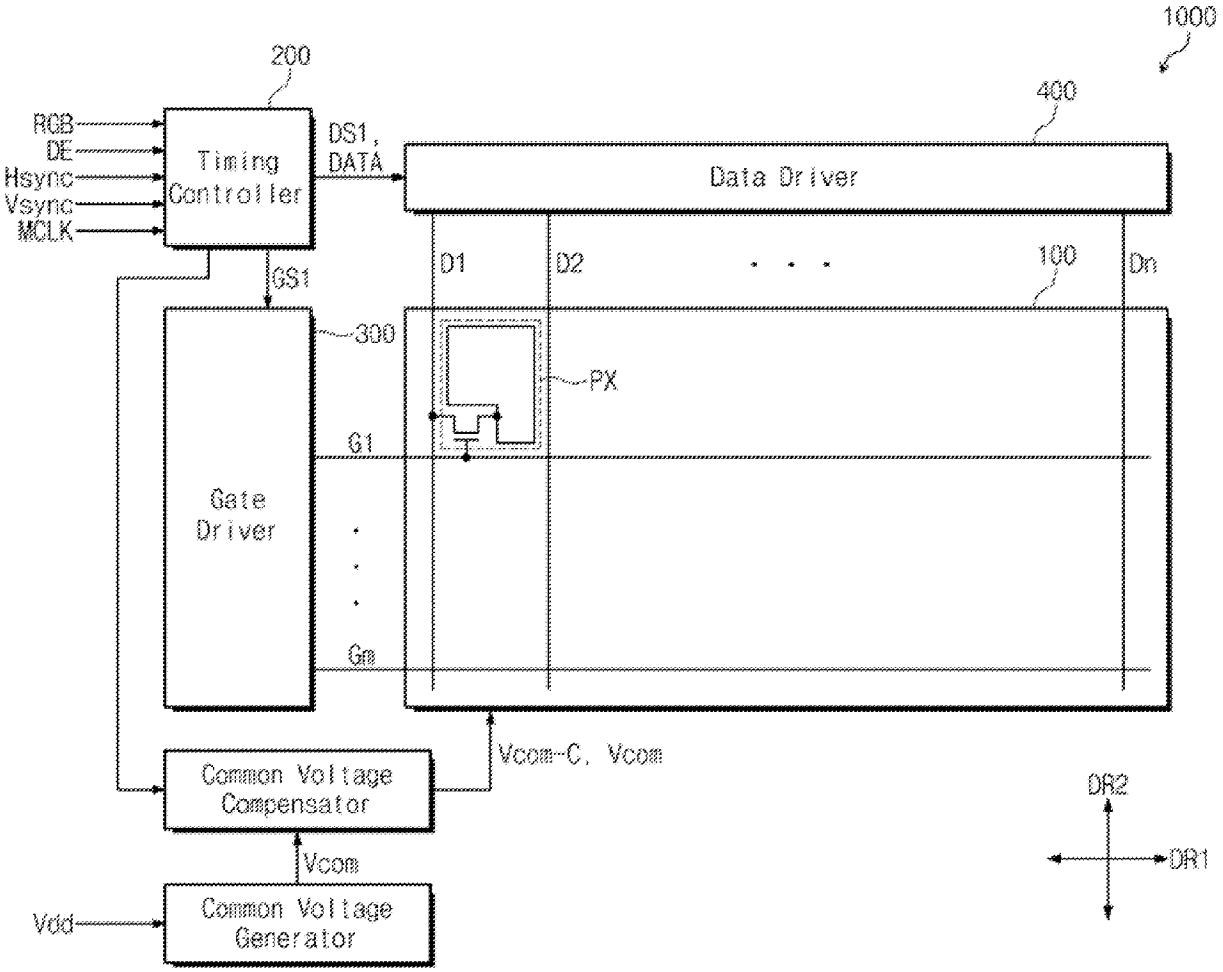
FIG. 1 is a schematic block diagram of a liquid crystal display device according to an embodiment of the inventive concept.

The inventive concept may be variously modified and embodied in various forms, and thus the inventive concept will be described in detail with reference to particular embodiments illustrated in the drawings. However, the particular embodiments disclosed in the present application are not intended to limit the inventive concept, but the inventive concept and all modifications, equivalents or substitutes within the inventive concept will be construed to be included in the scope of the inventive concept.

Hereinafter, the inventive concept will be described in detail with reference to the accompanying drawings.

Figure 2:
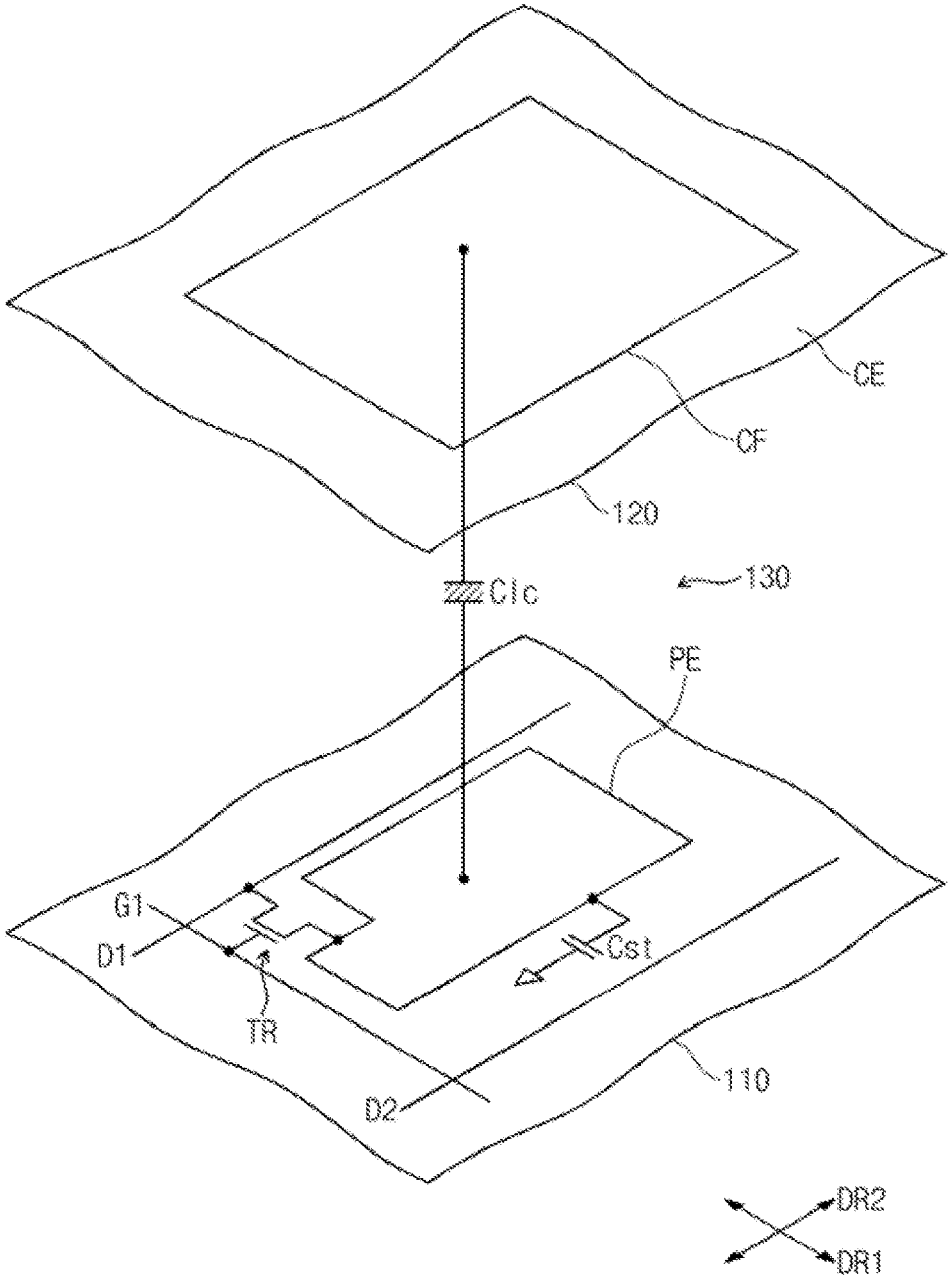
FIG. 2 is an equivalent circuit diagram of a pixel illustrated in FIG. 1.

FIG. 1 is a schematic block diagram of a liquid crystal display device according to an embodiment of the inventive concept. FIG. 2 is an equivalent circuit diagram of a pixel illustrated in FIG. 1.

As illustrated in FIG. 1, a liquid crystal display device 1000 according to an embodiment of the inventive concept includes a liquid crystal panel 100, a timing controller 200, a gate driver 300, a data driver 400, a common voltage generator 500, and a common voltage compensator 600.

The liquid crystal panel 100 may include a lower substrate 110, an upper substrate 120 facing the lower substrate 110, and a liquid crystal layer 130 disposed between two substrates 110, 120.

The liquid crystal panel 100 includes a plurality of gate lines G1 to Gm extending in a first direction DR1, and a plurality of data lines D1 to Dn extending in a second direction DR2 intersecting with the first direction DR1. The gate lines G1 to Gm and the data lines D1 to Dn define pixel regions, and each of the pixel regions includes a pixel PX displaying an image. FIG. 2 exemplarily illustrates a pixel PX connected to a first gate line G1 and a first data line D1.

The pixel PX may include a thin film transistor TR connected to the gate times G1 to Gm, specifically the gate line G1, a liquid crystal capacitor Clc connected to the thin film transistor TR, and a storage capacitor Cst connected to the liquid crystal capacitor Clc in parallel. The storage capacitor Cst may be omitted as necessary. The thin film transistor TR may be provided an the lower substrate 110. A gate electrode, a source electrode, and a drain electrode of the thin film transistor TR may be connected to the first gate line G1, the first data line D1, and the liquid crystal capacitor Clc and the storage capacitor Cst, respectively.

The liquid crystal capacitor Clc includes, as two terminals, a pixel electrode PE provided on the lower substrate 110 and a common electrode CE provided on the upper substrate 120, and the liquid crystal layer 130 disposed between two electrodes PE and CE acts as a dielectric. The pixel electrode PE is connected to the thin film transistor TR, the common electrode CE is entirely formed on the upper substrate 120 and receives a common voltage. Contrary to FIG. 2, the common electrode CE may be provided on the lower substrate 110, and in this case, at least one of two electrodes PE and CE may include a slit. The storage capacitor Cst performs an auxiliary role of the liquid crystal capacitor Clc, and may include the pixel electrode PE, a storage line (not illustrated), and a dielectric disposed between the pixel electrode PE and the storage line (not illustrated). The storage line (not illustrated) may be provided on the lower substrate 110 to overlap a portion of the pixel electrode PE. A constant voltage such as a storage voltage is applied to the storage line (not illustrated).

The pixel PX may express one of primary colors. The primary colors may include red, green, blue, and white. Alternatively, the primary colors are not limited thereto, but may further include various colors such as yellow, cyan, and magenta. The pixel PX may further include a color filter CF which expresses one of the primary colors. In FIG. 2, the color filter CF provided on the upper substrate 120 is exemplarily illustrated. The inventive concept is not limited thereto, but the color filter CF may be provided on the lower substrate 110.

The timing controller 200 receives image data RGB and control signals from an external graphic controller (not illustrated). The control signals may include a vertical synchronizing signal (hereinafter, referred to as 'Vsync' signal) for distinguishing frames, a horizontal synchronizing signal thereinafter, referred to as 'Hsync signal') for distinguishing rows, a data enable signal (hereinafter, referred to as 'DE signal') having a high level only during the output of image data to indicate valid image data, and a main clock signal MCLK.

The timing controller 200 converts the image data RGB or the image data modulated to fit the specifications of the data driver 400, and outputs converted image data DATA to the data driver 400. The timing controller 200 generates a gate control signal GS1 and a data control signal DS1. The timing controller 200 outputs the gate control signal GS1 to the gate driver 300, and outputs the data control signal DS1 to the data driver 400.

The gate control signal GS1 is a signal for driving the gate driver 300, and the data control signal DS1 is a signal for driving the data driver 400.

The gate driver 300 generates a gate signal based on the gate control signal GS1, and outputs the gate signal to the gate lines G1 to Gm. The gate control signal GS1 may include a scanning start signal which indicates the start of a scanning, at least one clock signal which controls output frequency of a gate-on voltage, and an output enable signal which defines time duration of the gate-on voltage.

The data driver 400 generates gray scale voltages according to the image data DATA based on the data control signal DS1, and outputs the generated gray scale voltages to the data lines D1 to Dn as data voltages. The data voltages may include positive data voltages having positive polarity and negative data voltages having negative polarity with respect to the common voltage. The data control signal DS1 may include a horizontal sum signal STH which signals a start of the image data DATA transfer to the data driver 400, a load signal which directs application of data voltages to the data lines D1 to Dn, and an inverse signal which inverts the polarities of the data voltages with respect to the common voltage.

The polarity of a data voltage applied to the pixel PX may be inversed after a frame ends and before the next frame starts so as to prevent degradation of the liquid crystal molecules. That is, the polarity of a data voltage may be inversed at every frame in response to an inversion signal applied to the data driver 400. When one frame of image is displayed, the liquid crystal panel 100 may be driven in such a way that data voltages having different polarity are applied thereto by every at least one data line in order to improve image quality.

The common voltage generator 500 converts an input power supply Vdd which is externally supplied into a DC power supply to generate a common voltage Vcom.

The common voltage compensator 600 analyzes the image data RGB, and determines whether it is necessary to compensate the common voltage Vcom. When it is determined that it is necessary to compensate the common voltage Vcom, the common voltage compensator 600 compensates the common voltage Vcom, and outputs a compensated common voltage Vcom-C to the common electrode CE of the liquid crystal panel 100. When it is determined that it is not necessary to compensate the common voltage Vcom, the common voltage compensator 600 outputs the common voltage Vcom to the common electrode CE of the liquid crystal panel 100 without any compensation.

The timing controller 200, the gate driver 300, and the data driver 400 each may be directly mounted on the liquid crystal panel 100 in the form of at least one integrated circuit chip, mounted on a flexible primed circuit board to be adhered to the liquid crystal panel 100 in the form of a tape carrier package, or mounted on a separate printed circuit board. Alternatively, at least one of the gate driver 300 and the data driver 400 may be integrated on the liquid crystal panel 100 together with the gate lines G1 to Gm, the data lines D1 to Dn, and the thin film transistor TR Furthermore, the timing controller 200, the gate driver 300, and the data driver 400 may be integrated as a single chip.

The common voltage generator 500 and the common voltage compensator 600 may be provided on a flexible printed circuit board or a printed circuit board.

Figure 3:
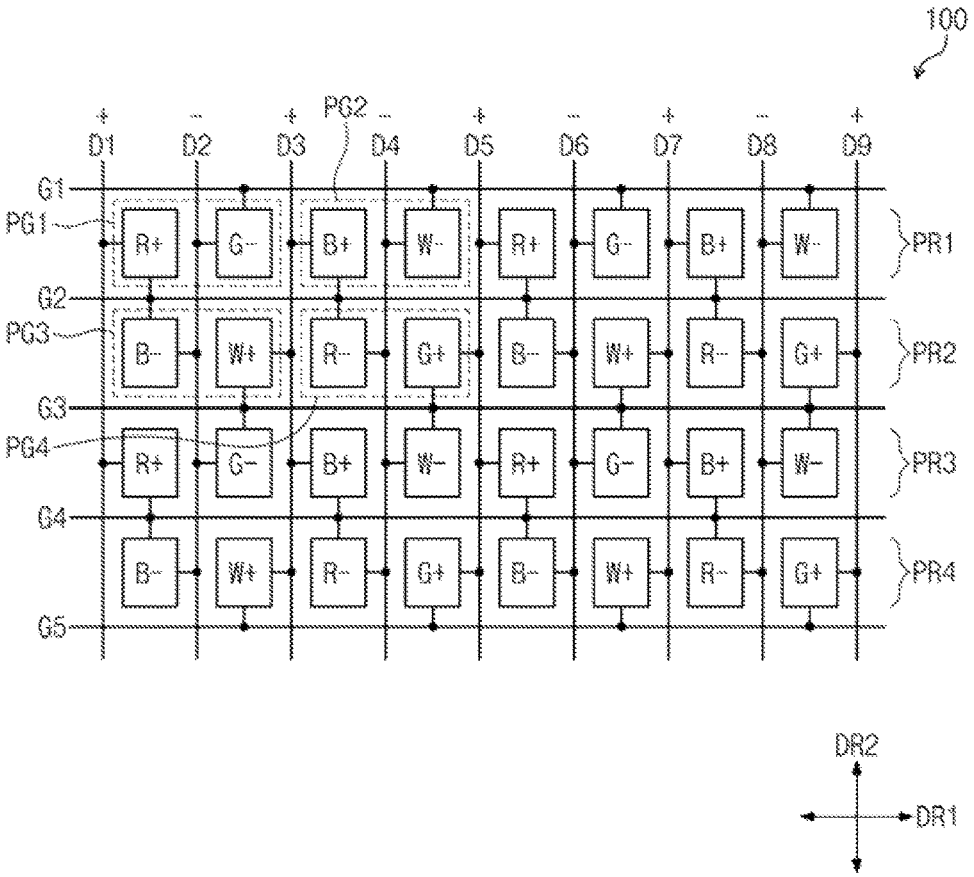
FIG. 3 is a plan view illustrating a portion of a liquid crystal panel according to an embodiment of the inventive concept.

FIG. 3 is a plan view illustrating a portion of a liquid crystal panel according to an embodiment of the inventive concept.

Referring to FIG. 3, the pixels include pixels in an h-th (h is a natural number) row and pixels in an (h+1)-th row. The first pixel row PR1 and the second pixel row PR2 are adjacent to each other in the second direction DR2 with a (k+1)-th (k is a natural number) gate line of the gate lines G1 to Gm disposed therebetween. FIG. 3 illustrates first to fourth pixel rows PR1 to PR4, and every other pixel row in the second direction DR2, e.g., pixel rows PR1, PR3, has the same structure as each other. Hereinafter, embodiments according to the inventive concept will be described with reference to FIG. 3, based on the first and second pixel rows PR1 and PR2 which correspond to the case when the k and h are equal to one.

The first pixel row PR1 includes a first pixel group PG1 and a second pixel group PG2 which are sequentially disposed in the first direction DR1. The second pixel row PR2 includes a third pixel group PG3 and a fourth pixel group PG4 which are sequentially disposed in the first direction DR1. Each of the first to fourth pixel groups PG1 to PG4 may include an even number of pixels. In FIG. 3, the first to fourth pixel groups PG1 to PG4 of which each includes two pixels are illustrated as an example.

Each of the first to fourth pixel groups PG1 to PG4 may display some of the primary colors. The first and fourth pixel groups PG1 and PG4 each include a red pixel and a green pixel. The second and third pixel groups PG2 and PG3 each include a blue pixel and a white pixel.

The first to fourth pixel groups PG1 to PG4 may be repetitively disposed.

In FIG. 3, red, green, blue, and while pixels are indicated by R, G, B, and W, respectively. Furthermore, pixels to which positive data voltages are applied during an i-th (i is a natural number) frame are indicated by R+, G+, B+, and W+. Pixels to which negative data voltages are applied during the i-th frame are indicated by R−, G−, B−, and W−.

The polarity of a data voltage provided to each pixel of the liquid crystal panel 100 in FIG. 3 refers to the polarity of the i-th frame, and the polarity of a data voltage provided to each pixel at an (i+1)-th frame is inversed. That is, the data driver 400 in FIG. 1 inverts the polarities of data voltages which are output to the data lines D1 to Dn, at every frame.

Alternatively, the arrangement order of pixels is not limited to an embodiment in FIG. 3, but may be modified in various forms. That is, in each of the first and second pixel rows PR1 and PR2, positions of red, green, blue, and white pixels may be variously modified. Specifically, each of the first and fourth pixel groups PG1 and PG4 may include a red pixel and a blue pixel, and each of the second and third pixel groups PG2 and PG3 may include a green pixel and a white pixel. Furthermore, each of the first and fourth pixel groups PG1 and PG4 may include a red pixel and a white pixel, and each of the second and third pixel groups PG2 and PG3 may include a green pixel and a blue pixel.

According to embodiments of the inventive concept, the polarities of data voltages applied to the data lines D1 to D9 may be inverted by every data line. FIG. 3 exemplarily illustrates that positive data voltages are applied to odd-numbered data lines D1, D3, D5, D7 and D9, and negative data voltages are applied to even-numbered data lines D2, D4, D6 and D8.

According to embodiments of the inventive concept, pixels in a u-th (u is a natural number) column, which are disposed between a j-th (j is a natural number) data line and a (j+1)-th data line of the data lines, may be alternately connected to the j-th data line and the (j+1)-th data line by every at least one pixel. Hereinafter, an example when the j and u are equal to one will be described with reference to FIG. 3.

Pixels in a first column, which are disposed between the first data line D1 and the second data line D2, may be alternately connected to the first data line D1 and the second data line D2 by every pixel. In other words, pixels constituting one column may be alternately connected to data lines of the left and right sides by every row. Specifically, a red pixel R+ of the first pixel group PG1 may be connected to the first data line D1, and a blue pixel B− of the third pixel group PG3 may be connected to the second data line D2.

According to embodiments of the inventive concept, two pixels which are adjacent to each other in the second direction DR2 with a 2k-th gate line disposed therebetween, among pixels in a (2u−1)-th column, share the 2k-th gate line to be connected to each other. Furthermore, two pixels which are adjacent to each other in the second direction DR2 with a (2k−1)-th gate line disposed therebetween, among pixels in a 2u-th column, share the (2k−1)-th gate line to be connected to each other.

Specifically, a red pixel R+ and a blue pixel B− which are adjacent to each other with the second gate line G2 disposed therebetween, among the pixels in the first column, share the second gate line G2 to be connected to each other, and a red pixel R− and a blue pixel B+ which are adjacent to each other with the second gate line G2 disposed therebetween, among pixels in a third column, share the second gate line G2 to be connected to each other. Therefore, the red pixel R+ and the blue pixel B− in the first column, which are connected to the second gate line G2, are driven by a gate signal applied to the second gate line G2. Furthermore, the red pixel R− and the blue pixel B+ in the third column, which are connected to the second gate line G2, are driven by a gate signal applied to the second gate line G2.

Also, a while pixel W+ and a green pixel G−, which are adjacent to each other with a third gate line G3 disposed therebetween, among pixels in a second column, share the third gate line G3 to be connected to each other, and a white pixel W− and a green pixel G+, which are adjacent to each other with the third gate line G3 disposed therebetween, among pixels in a fourth column, share the third gate line G3 to be connected to each other. Therefore, the white pixel W+ and the green pixel G− in the second column, which are connected to the third gate line G3, are driven by a gate signal applied to the third gate line G3. Furthermore, the white pixel W− and the green pixel G+ in the fourth column, which are connected to the third gate line G3, are driven by a gate signal applied to the third gate line G3.

Alternatively, the inventive concept is not limited thereto, in other embodiments, two pixels, which are adjacent to each other in the second direction DR2 with a (2k−1)-th gate line disposed therebetween, among pixels in a (2u−1)-th column, may share the (2k−1)-th gate line to be connected to each other. Furthermore, two pixels, which are adjacent to each other in the second direction DR2 with a 2k-th gate line disposed therebetween, among pixels in a 2u-th column, may share the 2k-th gate line to be connected to each other.

According to embodiments of the inventive concept, first pixels which display a first color and are connected to the (k+1)-th gate line among the pixels in the h-th row, and second pixels which display the first color and are connected to the (k+1)-th gate line among the pixels in the (h+1)-th row, may receive data voltages having different polarities. The first pixels and the second pixels may be spaced from each other in the first direction DR1. The first pixels and the second pixels may be spaced from each other in the first direction DR1 with an odd number of columns of pixels disposed therebetween. That is, a column that each of the first pixels constitutes and a column that each of the second pixels constitutes may be different from each other.

The first color may be the primary color, that is, any one of red, green, blue, and white.

Within the first to fourth pixel groups PG1 to PG4, when the first pixel is included in the first pixel group PG1, the second pixel may be included in the fourth pixel group PG4. In still other embodiments, when the first pixel is included in the second pixel group PG2, the second pixel may be included in the third pixel group PG3. In other words, when the first pixel is included in pixels in a (2u−1)-th column, the second pixel may be included in pixels in a (2u+1)-th column. Furthermore, when the first pixel is included in pixels in a 2u-th column, the second pixel may be included in pixels in a (2u+2)-th column.

For example, when the first color is red and each of the first and second pixels is a red pixel red pixels R+ in the first pixel row PR1 and red pixels R− in the second pixel row PR2 are connected to the second gate line G2, and receive data voltages having different polarities.

Figure 4A:
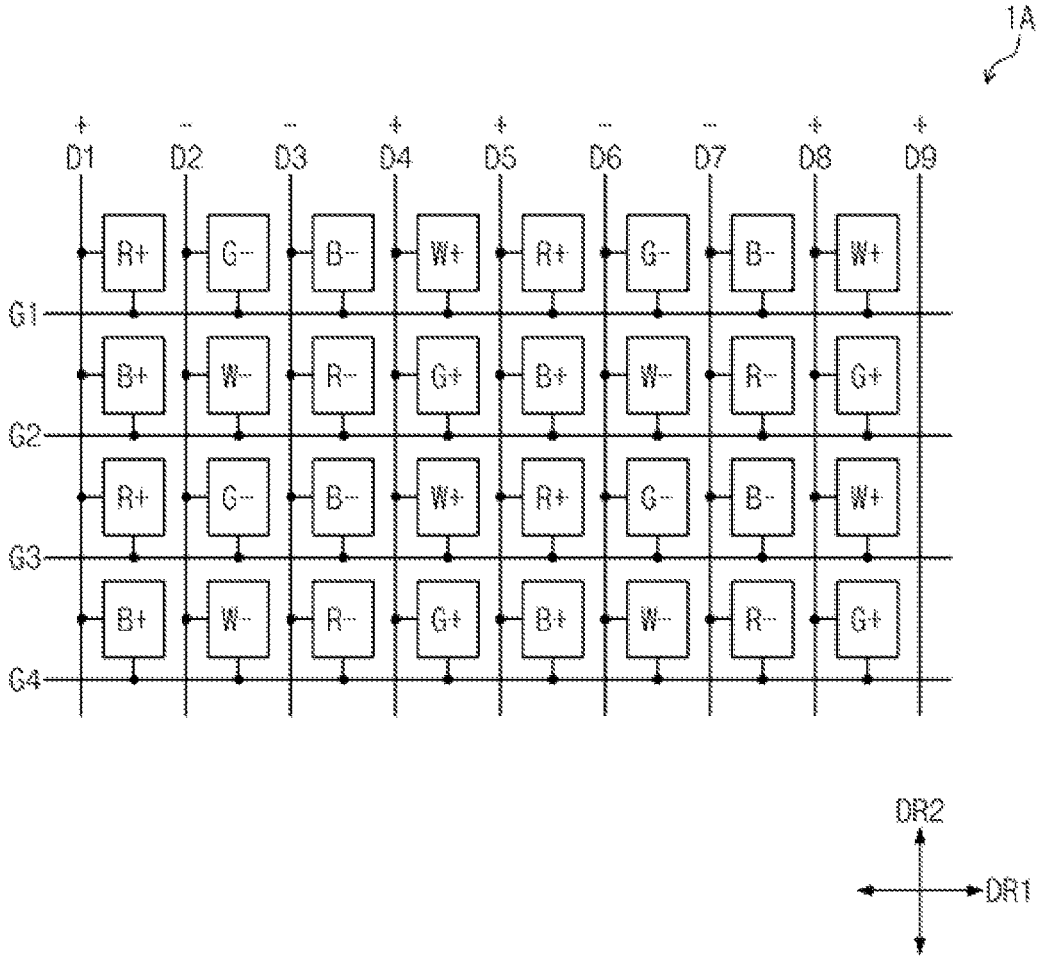
FIG. 4A is a plan view illustrating a portion of a liquid crystal panel according to comparative example 1.
Figure 4B:
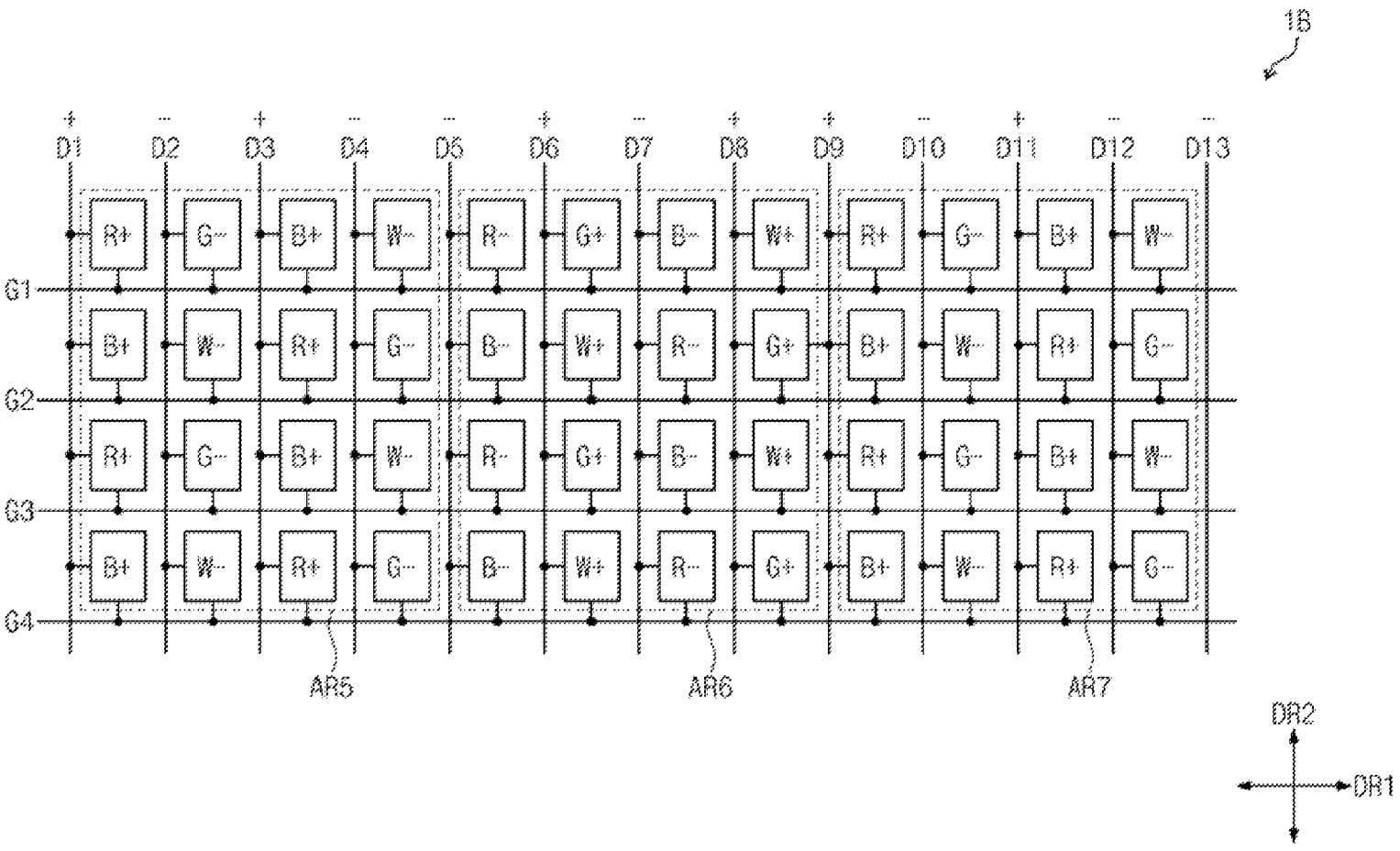
FIG. 4B is a plan view illustrating a portion of a liquid crystal panel according to comparative example 2.

FIG. 4A is a plan view illustrating a portion of a liquid crystal panel according to comparative example 1. FIG. 4B is a plan view illustrating a portion of a liquid crystal panel according to comparative example 2.

Hereinafter, liquid crystal panels according to comparative examples 1 and 2 will be described with reference to FIGS. 4A and 4B, and the effect of the liquid crystal panel in FIG. 3 according to an embodiment of the inventive concept will be described.

Referring to FIGS. 4A and 4B, a first comparative liquid crystal panel 1A according to comparative example 1 and a second comparative liquid crystal panel 1B according to comparative example 2 each may include a plurality of pixels. Pixels in odd-numbered rows are disposed in the order of a red pixel, a green pixel, a blue pixel, and a white pixel, and pixels in even-numbered rows are disposed in the order of a blue pixel, a white pixel, a red pixel, and a green pixel.

Each of the pixels of the first and second comparative liquid crystal panels 1A and 1B is connected to a gate line in a lower portion and a data line in a left side.

The polarities of data voltages applied to data lines D1 to D9 of the first comparative liquid crystal panel 1A may be repeated in the order of positive polarity, negative polarity, negative polarity, and positive polarity. Specifically, the polarities of data voltages applied to the data lines D1 to D9 of the first comparative liquid crystal panel 1A may have a sequence of +--++--++.

The polarities of data voltages applied to data lines D1 to D9 of the second comparative liquid crystal panel 1B may be inverted by every four data lines, and may be inverted by every data line within the four data lines. Specifically, the polarities of data voltages applied to the data lines D1 to D9 of the second comparative liquid crystal panel 1B may have a sequence of +-+--+-++.

The polarities of data voltages applied to the pixels of the first and second comparative liquid crystal panels 1A and 1B is inverted at every frame.

Figure 5:
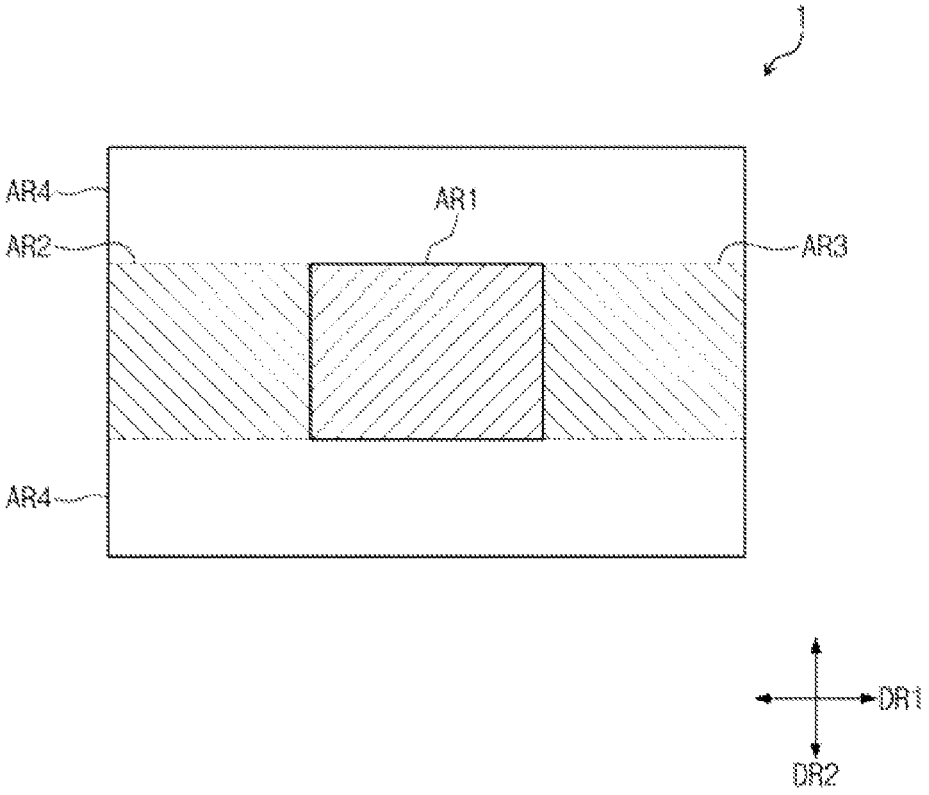
FIG. 5 is a schematic diagram illustrating a liquid crystal panel in which horizontal crosstalk has been generated.

FIG. 5 is a schematic diagram illustrating a liquid crystal panel in which horizontal crosstalk has been generated.

FIG. 5 exemplarily illustrates a liquid crystal panel 1 which displays a primary color (e.g., red) in a first region AR1.

If overall polarity of data voltages applied to pixels which display the primary color during one horizontal scanning section 1H is biased to positive polarity or negative polarity, a common voltage may not be kept constant due to a coupling phenomenon between data lines and the common electrode, and a ripple may be caused thereby in the common voltage in a positive direction or a negative direction. In this case, in second and third regions AR2 and AR3 which are adjacent, in a first direction DR1, to the first region AR1 displaying the primary color in the liquid crystal panel 1 in FIG. 5, a horizontal crosstalk phenomenon may be caused such that a luminance difference may be visible as compared with a peripheral region AR4.

Referring to FIG. 4A, it is assumed that red pixels in the first comparative liquid crystal panel 1A are driven by positive or negative data voltages. Referring to FIG. 4A, red pixels R+ included in pixels in a first row receive positive data voltages by a gate signal applied to a first gate line G1 during a first horizontal scanning section 1H. In this case, a ripple may be generated in the common voltage in a positive direction, thereby causing the horizontal crosstalk phenomenon. Furthermore, red pixels R− included in pixels in a second row receive negative data voltages by a gate signal applied to a second gate line G2 during the next horizontal scanning section 1H. In this case, a ripple may be generated in the common voltage in a negative direction, thereby causing the horizontal crosstalk phenomenon.

Referring to FIG. 4B, it is assumed that red pixels in the second comparative liquid crystal panel 1B are driven by positive or negative data voltages. Referring to FIG. 4B, the second comparative liquid crystal panel 1B may display a red image in fifth and sixth regions AR5 and AR6 during an i-th frame, and display a red image in sixth and seventh regions AR6 and AR7 during an (i+1)-th frame. In this case, since a luminance difference is generated between red pixels to which positive data voltages are applied and red pixels to which negative data voltages are applied, a vertical line may be seen as if it moves during the progress from the i-th frame to the (i+1)-th frame. The phenomenon that a vertical line is visible as if it moves is defined as a moving striped stain. The moving striped stain may be problematic when all the pixels are driven like white as well as when a particular color is expressed.

That is, the horizontal crosstalk is visible as a major defect in the first comparative liquid crystal panel 1A in FIG. 4A, and the moving striped stain is visible as a major defect in the second comparative liquid crystal panel 1B in FIG. 4B.

Referring to FIG. 3 again, the red pixels R+ included in the pixels in the first row and the red pixels R− included in the pixels in the second row of the liquid crystal panel 100 according to an embodiment of the inventive concept, are driven by a gate signal applied to the second gate line G2 during one horizontal scanning section.

The first and fifth data lines D1 and D5 are connected to the red pixels R+ in the first row to provide positive data voltages. Furthermore, the fourth and eighth data lines D4 and D8 are connected to the red pixels R− in the second row to provide a negative voltage. That is, overall polarity of data voltages applied to display red during one horizontal scanning section is offset, and thus no ripple is caused in the common voltage. As a result, the horizontal crosstalk phenomenon may be prevented.

Furthermore, in the liquid crystal panel 100 in FIG. 3 according to an embodiment of the inventive concept, pixels included in pixels in one row receive data voltages having the same polarity, and thus the moving striped stain phenomenon may be prevented. That is, according to the inventive concept, the horizontal crosstalk phenomenon and the moving striped stain phenomenon may be prevented at the same time.

Figure 6:
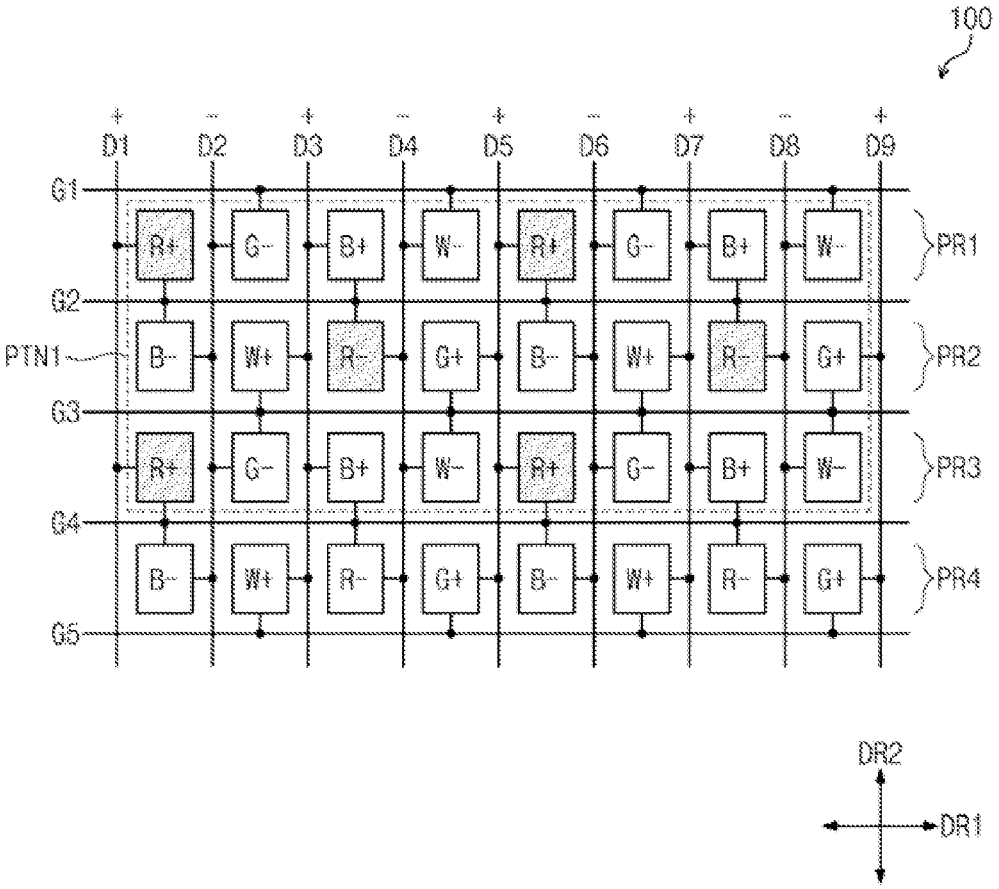
FIG. 6 illustrates a first pattern of image data that the liquid crystal panel in FIG. 3 displays.
Figure 9:
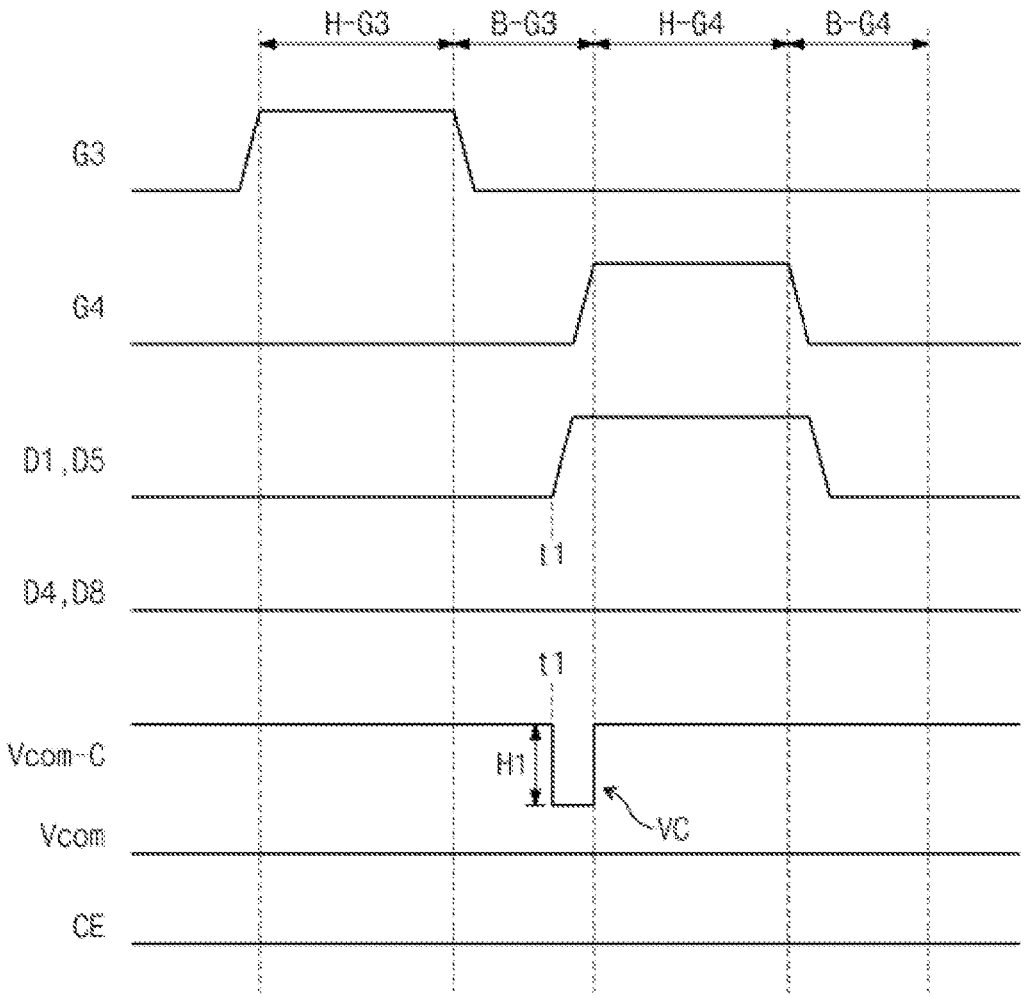
FIG. 9 is a timing diagram when the liquid crystal panel in FIG. 6 displays the first pattern, illustrating signals applied to the liquid crystal panel and the level of a common electrode to which a compensated common voltage is applied.

FIG. 6 illustrates a first pattern of image data that the liquid crystal panel in FIG. 9 displays.

Referring to FIGS. 1 and 6, the image data RGB may display a first pattern PTN1 on the liquid crystal panel 100. The first pattern PTN1 may display an image at the first pixels and may not display any image at the second pixels, among the first pixels and the second pixels which share one gate line. That is, a boundary of the first pattern PTN1, extending in the first direction DR1, lies between the first pixels and the second pixels. The first pattern PTN1 displays an image at the first pixels included in the third pixel row PR3, and does not display any image at the second pixels included in the fourth pixel row PR4.

Hereinafter, it will be described as an example that the first pattern PTN1 is a red image displayed in the first to third pixel rows PR1 to PR3. Also, it will be described as an example that a black image is displayed in the fourth pixel row PR4 in which the first pattern PTN1 is not displayed. As the first pattern PTN1 is displayed, red pixels included in the first to third pixel rows PR1 to PR3 may display a red image.

Figure 7:
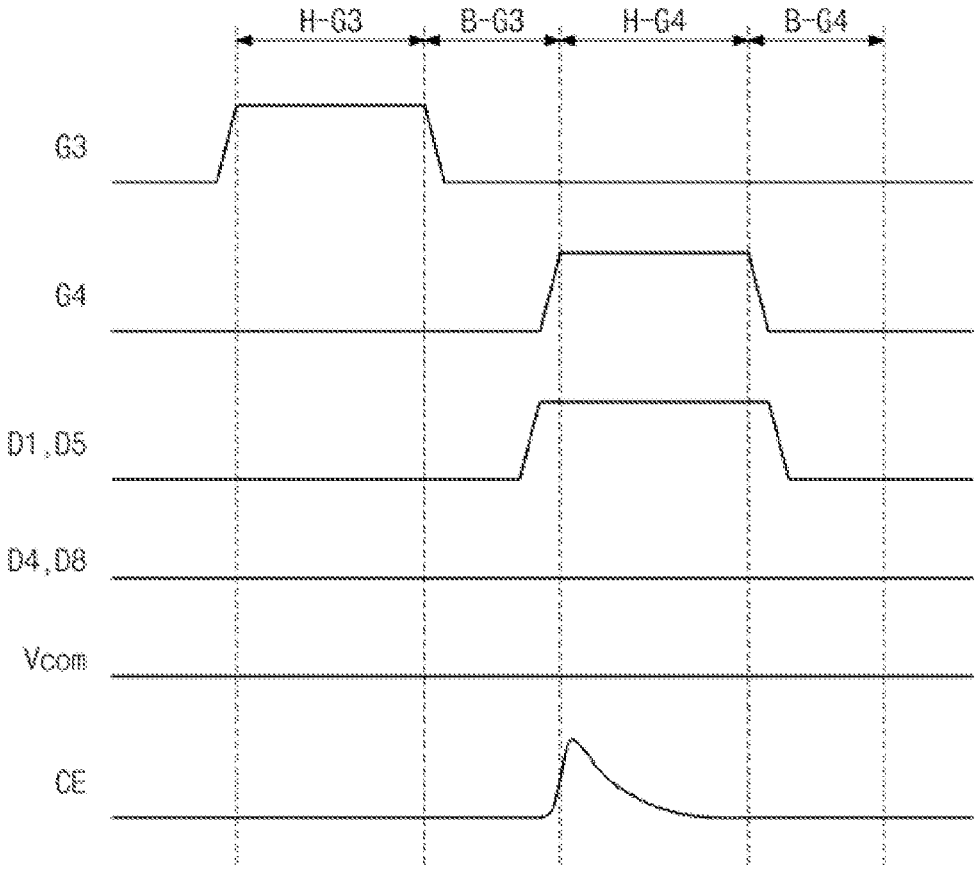
FIG. 7 is a timing diagram when the liquid crystal panel in FIG. 6 displays the first pattern, illustrating signals applied to the and crystal panel and the level of a common electrode to which a common voltage is applied.

FIG. 7 is a timing diagram when the liquid crystal panel in FIG. 6 displays the first pattern, illustrating signals applied to the liquid crystal panel and the level of a common electrode to which a common voltage is applied.

Referring to FIGS. 1, 2, 6, and 7, each of the gate lines G1 to G5 receives a gate signal during a horizontal scanning section. A horizontal blank section is provided between adjacent horizontal scanning sections. During the horizontal blank section, gate signals are not applied to the gate lines G1 to G5.

For example, a third gate signal may be applied to the third gate line G3 during a third horizontal scanning section H-G3, and a fourth gate signal may be applied to the fourth gate line G4 during a fourth horizontal scanning section H-G4. A third horizontal blank section H-G3 is provided between the third and fourth horizontal scanning sections H-G3 and H-G4. A fourth horizontal blank section B-G4 is provided between the fourth horizontal scanning section H-G4 and a fifth horizontal scanning section (not illustrated).

During a section overlapping the fourth horizontal scanning section H-G4, positive data voltages are applied to the first and fifth data lines D1 and D5, and the red pixels R+ in the third pixel row PR3 may display a red image. However, during the section overlapping the fourth horizontal scanning section H-G4, no data voltage is applied to the fourth and eighth data lines D4 and D8, and the red pixels R− in the fourth pixel row PR4 do not display any image.

Generally, the level of the common electrode CE will have a constant level of the common voltage Vcom. However, during the section in which positive data voltages are applied to die first and fifth data lines D1 and D5, the level of the common electrode CE may be higher that the common voltage Vcom due to the coupling phenomenon. Thus, single line horizontal crosstalk may be caused thereby along the fourth gate line G4.

Figure 8:
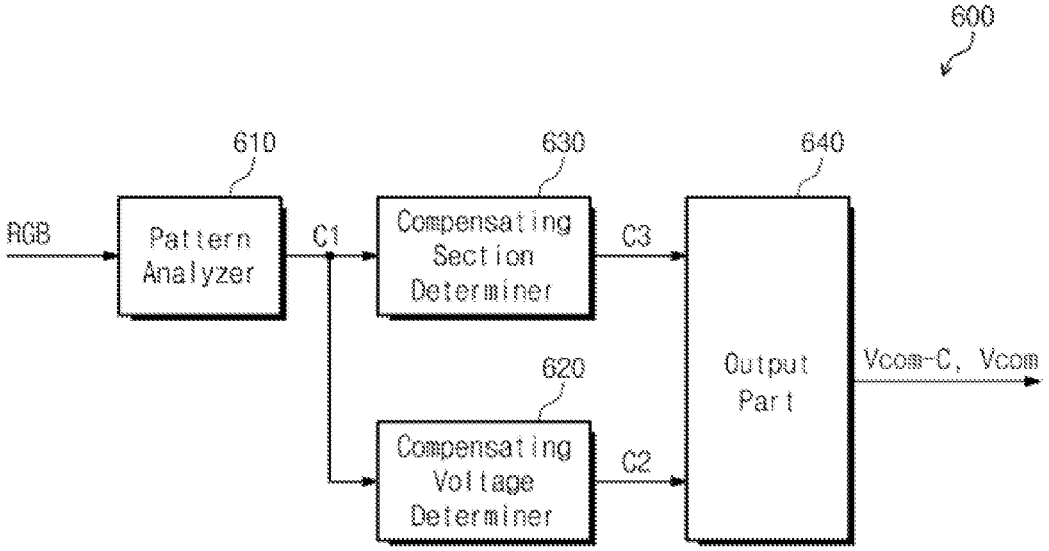
FIG. 8 illustrates the common voltage compensator in FIG. 1.

FIG. 8 illustrates the common voltage compensator 600 in FIG. 1. FIG. 9 is a liming diagram when the liquid crystal panel in FIG. 6 displays the first pattern, illustrating signals applied to the liquid crystal panel and the level of a common electrode to which a compensated common voltage is applied.

Referring to FIGS. 1, 6, 8, and 9, the common voltage compensator 600 may include a pattern analyzer 610, a compensating voltage determiner 620, and a compensating section determiner 630.

The pattern analyzer 610 analyzes a pattern included in the image data RGB. The pattern analyzer 610 analyzes whether the pattern of the image data RGB displays an image at one of the first pixels and the second pixels. The first pixels and the second pixels share one gate line, display the same color, and may be disposed in different pixel rows. For example, die pattern analyzer 610 analyzes whether the pattern of the image data RGB displays an image at the first pixels, and does not display an image at the second pixels. In other words, the pattern analyzer 610 determines whether a boundary of the pattern of the image data RGB, extending in the first direction DR1, lies between the first pixels and the second pixels.

The pattern analyzer 610 outputs an analytical signal C1 including information on whether the boundary of the pattern included in the image data RGB, extending in the first direction DR1, lies between the first pixels and the second pixels. When the image data RGB has the first pattern PTN1 in FIG. 6, a boundary of the first patient PTN1, extending in the first direction, lies between the third and fourth pixel rows PR3 and PR4. Therefore, the pattern analyzer 610 will determine the boundary of the first pattern PTN1, extending in the first direction DR1, lies between the first pixels and the second pixels.

The pattern analyzer 610 analyzes the image data RGB using a 3×3 mask filter, and may find the boundary of the pattern of the image data RGB, extending in the first direction DR1. Specifically, the pattern analyzer 610 sequentially scans and analyzes the image data RGB by each data corresponding to 3×3 pixels, and may find the boundary of the pattern of the image data RGB, extending in the first direction DR1, based on the analyzed results.

The compensating voltage determiner 620 receives the analytical signal C1, and may determine the magnitude H1 of a compensating voltage VC to be compensated to the common voltage Vcom and the polarity of the compensating voltage VC when the boundary of the pattern included in the image data RGB, extending in the first direction DR1, lies between the first pixels and the second pixels.

The compensating voltage determiner 620 determines the magnitude H1 of the compensating voltage VC, based on the number of pixels displaying a pattern and the level of data voltages applied to the pixels displaying the pattern. The pixels displaying the pattern may be the first pixels or the second pixels which display the pattern included in the image data RGB.

For instance, when the image data RGB has the first pattern PTN1 in FIG. 6, the compensating voltage determiner 620 determines the magnitude H1 of the compensating voltage VC, based on the number of the red pixels R+ in the third pixel row PR3 and data voltages applied to the red pixels R+ in the third pixel tow PR3 (data voltages applied to the first and fifth data lines D1 and D5).

The compensating voltage determiner 620 may include a lookup table (not illustrated) which stores the magnitude of a compensating voltage VC according to the number of the pixels displaying a pattern and the level of data voltages applied to the pixels displaying the pattern. The compensating voltage determiner 620 may read the magnitude of a required compensating voltage VC from the lookup table (not illustrated).

The compensating voltage determiner 620 may set the polarity of the compensating voltage VC to be opposite to that of data voltages applied to the pixels displaying the pattern among the first pixels and the second pixels.

The compensating voltage determiner 620 may set the polarity of the compensating voltage VC to be opposite to that of data voltages applied to at least a portion of the first pixels when a pattern is displayed in at least a portion of the first pixels and the pattern is not displayed at the second pixels. Likewise, the compensating voltage determiner 620 may set the polarity of the compensating voltage VC to be opposite to mat of data voltages applied to at least a portion of the second pixels when a pattern is displayed in at least a portion of the second pixels and the pattern is not displayed at the first pixels.

For instance, when the image data RGB has the first pattern PTN1 in FIG. 6, positive data voltages are applied to the red pixels R+ in the third pixel row PR3, and the compensating voltage determiner 620 may thus set the polarity of the compensating voltage VC to be negative.

The compensating voltage determiner 620 may output a compensating voltage signal C2 including information on the magnitude H1 of a compensating voltage VC and the polarity of the compensating voltage VC.

The compensating section determiner 630 receives the analytic signal C1, and may determine a compensating section in which the common voltage Vcom is to be compensated when the boundary of the pattern of the image data RGB, extending in the first direction DR1, lies between the first pixels and the second pixels. The compensating section may be determined to be a section capable of preventing the level of the common electrode CE from being changed due to a coupling with data voltages. The compensating section determiner 630 outputs a compensating section signal C3 including information on the compensating section.

The compensating section determiner 630 may set the compensating section to be within a horizontal blank section between a k-th horizontal scanning section in which a k-th gate signal is applied to the k-th gate line and a (k+1)-th horizontal scanning section in which a (k+1)-th gate signal is applied to the (k+1)-th gate line. For instance, when the image data RGB has the first pattern PTN1 in FIG. 6, the compensating section determiner 630 may set the compensating section to be within the third horizontal blank section B-G3.

The compensating section determiner 630 may set the compensating section to be a section from a first point of time t1 within the horizontal blank section to a point of time at which the (K+1)-th horizontal scanning section starts. The first point of time t1 may be set to be a point of time at which data voltages are applied to the first pixels which display the pattern included in the image data RGB or a point of time at which data voltages are applied to the second pixels which display the pattern included in the image data RGB.

For instance, when the image data RGB has the first pattern PTN1 in FIG. 6, the compensating section determiner 630 may set the compensating section to be a section from the first point of time at which data voltages are applied to the red pixels R+ in the third pixel row PR3 through the first and fifth data lines D1 and D5, to a point of time at which the fourth horizontal scanning section H-G4 starts.

The output part 640 receives the compensating voltage signal C2 and the compensating section signal C3. When the boundary of the pattern included in the image data RGB, extending lit the first direction DR1, lies between the first pixels and the second pixels, the output part 640 may output the compensated common voltage Vcom-C which is generated based on the compensating voltage signal C2 and the compensating section signal C3. The compensated common voltage Vcom-C may be a voltage obtained by adding, to the common voltage Vcom, the compensating voltage VC during the compensating section. When the boundary of the pattern of the image data RGB, extending in the first direction DR1, does not lie between the first pixels and the second pixels, the output part 640 may output the common voltage Vcom.

Referring to FIG. 9, when the liquid crystal panel 100 displays the first pattern a PTN1, the level of the common electrode CE to which the compensated common voltage Vcom-C is applied may be kept constant. That is, according to a display device in accordance with an embodiment of the inventive concept, when a boundary of a pattern of image data RGB, extending in the first direction DR1, lies between the first pixels and the second pixels, the compensated common voltage Vcom-C is applied to the common electrode CE, and thus single line crosstalk may be prevented.

Figure 10:
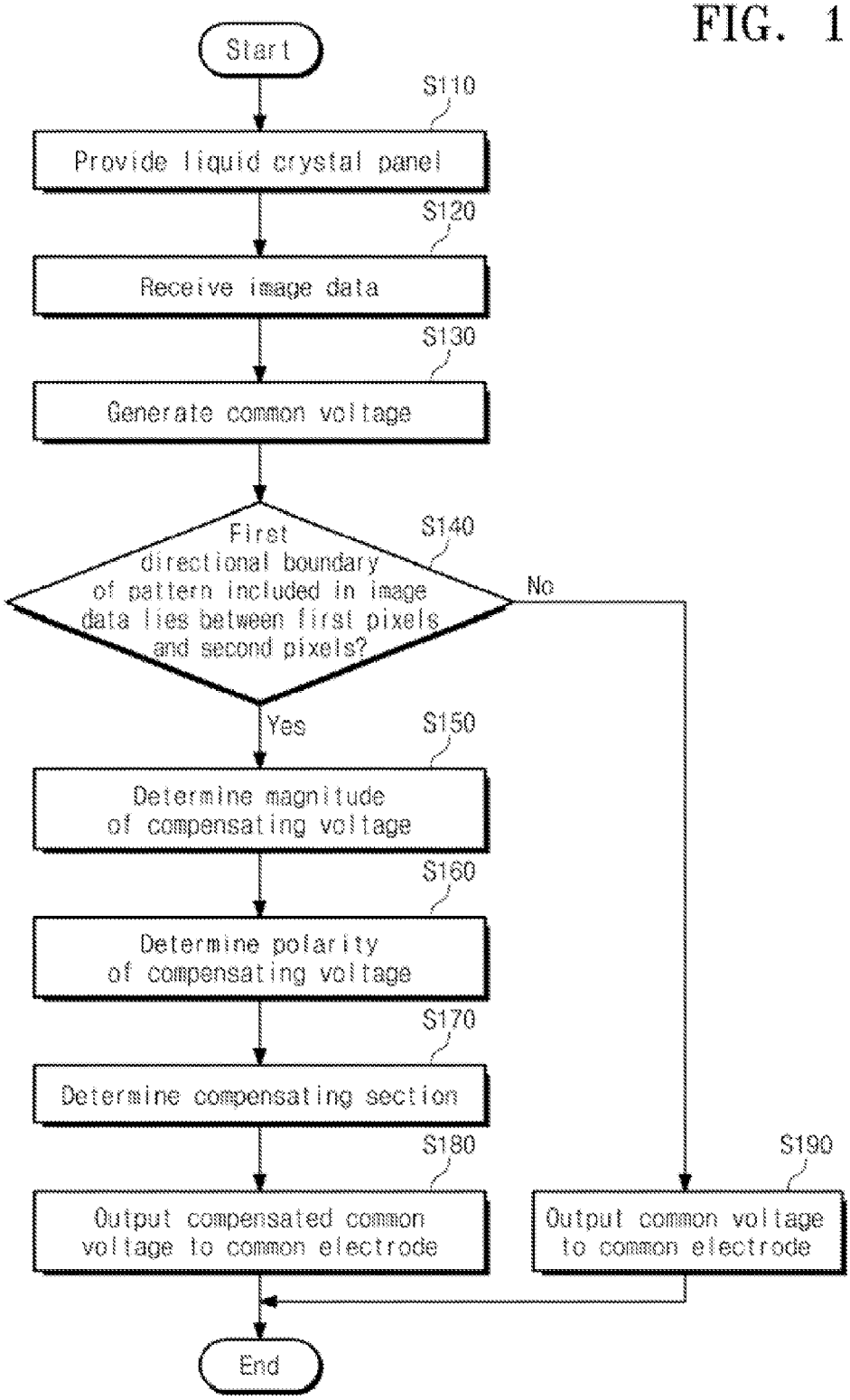
FIG. 10 is a flow diagram illustrating a driving method of a display device according to an embodiment of the inventive concept.
Figure 11:
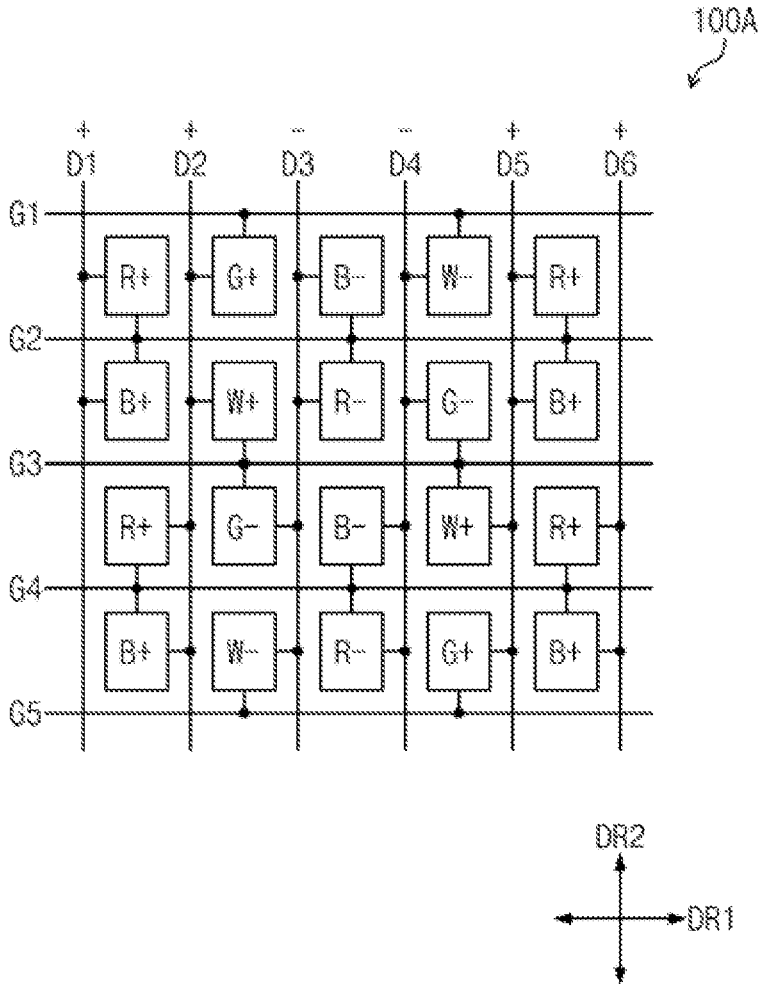
FIGS. 11, 12, 13, 14, 15, 16, 17, 18, 19, 20, and 21 are plan views of liquid crystal panels according to various embodiments of the inventive concept.

FIG. 10 is a flow diagram illustrating a driving method of a display device according to an embodiment of the inventive concept.

Referring to FIGS. 1, 3, 6, 9, and 10, a liquid crystal panel 100 is provided (S110). Since the liquid crystal panel 100 was described with reference to FIG. 3, detailed descriptions thereof will be omitted. Liquid crystal panels 100A to 100K may also be used, which are illustrated in FIGS. 11 to 21 and will be described later.

A timing controller 200 receives image data RGB (S120). A common voltage Vcom to be provided to a common electrode CE is generated (S130). The common voltage Vcom may be generated based on an input power supply which is externally supplied.

Subsequently, it is determined whether a boundary of a pattern included in the image data RGB, extending in the first direction DR1, lies between the first pixels and the second pixels (S140). Step S140 may be performed such that the image data RGB is sequentially scanned and analyzed by each data corresponding to 3×3 pixels. Step S140 is a step for selecting image data including patterns which may cause single line crosstalk.

If, in step S140, it is determined that the boundary of the pattern included in the image data RGB, extending in the first direction DR1, does not lie between the first pixels and the second pixels, then step S190 is performed. In step S190, the common voltage Vcom is output to the common electrode CE. That is, the common voltage Vcom is not compensated.

If, in step S140, it is determined that the boundary of the pattern included in the image data RGB, extending in the first direction DR1, lies between the first pixels and the second pixels, then steps S150 to S180 are performed, in which the common voltage Vcom is compensated. The common voltage Vcom may be compensated before a (k+1)-th gate signal is applied to the (k+1)-th gate line.

In step S150, the magnitude of a compensating voltage VC to be compensated to the common voltage Vcom is determined. The magnitude of the compensating voltage VC may be determined, based on the number of pixels displaying the pattern among the first pixels and the second pixels and the level of data voltages applied to the pixels displaying the pattern.

In step S160, the polarity of the compensating voltage VC is determined. The polarity of the compensating voltage VC may be set to be opposite to that of data voltages applied to the pixels displaying the pattern among the first pixels and the second pixels.

In step S170, a compensating section is determined, in which the common voltage Vcom is to be compensated. The compensating section may be set to be within a horizontal blank section between a k-th horizontal scanning section in which a k-th gate signal is applied to the k-th gate line and a (k+1)-th horizontal scanning section in which a (k+1)-th gate signal is applied to the (k+1)-th gate line. The compensating section may be set to be a section from a first point of time within the horizontal blank section to a point of time at which the (k+1)-th horizontal scanning section starts.

Subsequently, in step 180, a compensated common voltage Vcom-C which is obtained by compensating the common voltage Vcom, is output to the common electrode CE.

FIGS. 11 to 21 are plan views of liquid crystal panels according to various embodiments of the inventive concept. Hereinafter, various embodiments of the inventive concept will be described with reference to FIGS. 11 to 21. Various embodiments below will be described with a focus on the differences from the liquid crystal panel in FIG. 3, and other details not described are intended to be in accordance with FIG. 3.

In embodiments below, the polarities of data voltages applied to data lines may be inverted by every two data lines. FIGS. 11 to 21 exemplarily illustrate that the polarities of data voltages applied to data lines have a sequence of +--++--.

The liquid crystal panels 100A to 100D in FIGS. 11 to 14 differ, in common, from the liquid crystal panel in FIG. 3 in that pixels included in a column are alternately connected to data lines adjacent to each other by every two dots. Referring to FIGS. 11 to 14, pixels in a u-th (u is a natural number) column disposed between a j-th (j is a natural number) data line and a (j+1)-th data line may be alternately connected to the j-th data line and the (j+1)-th data line by every two pixels.

Figure 12:
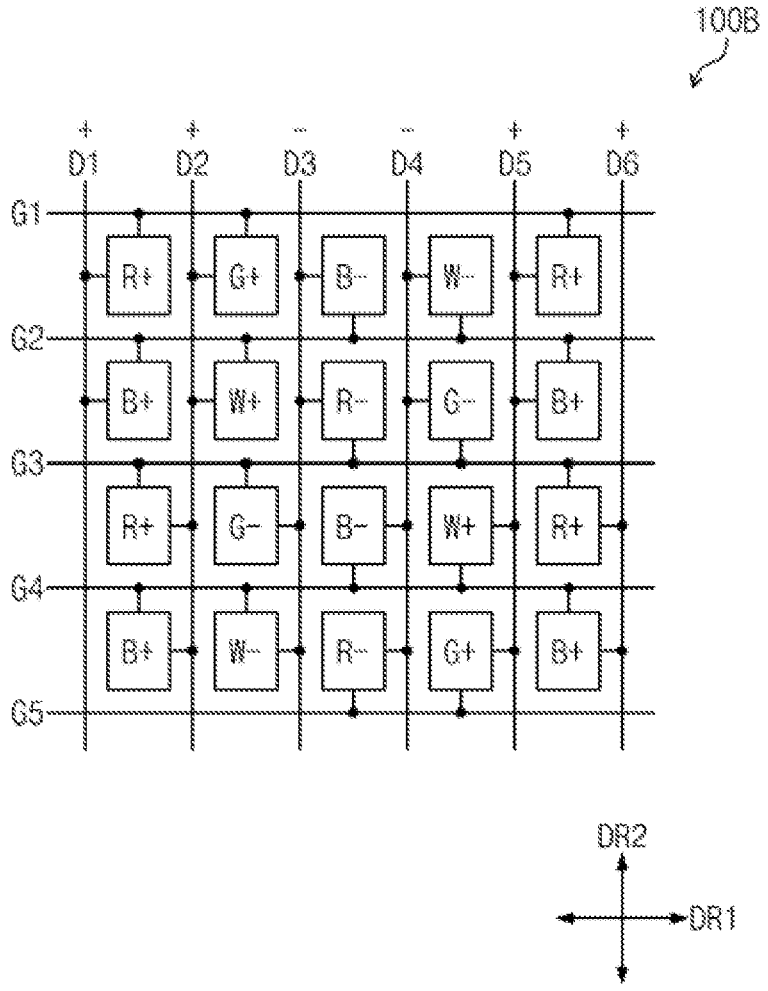
Figure 13:
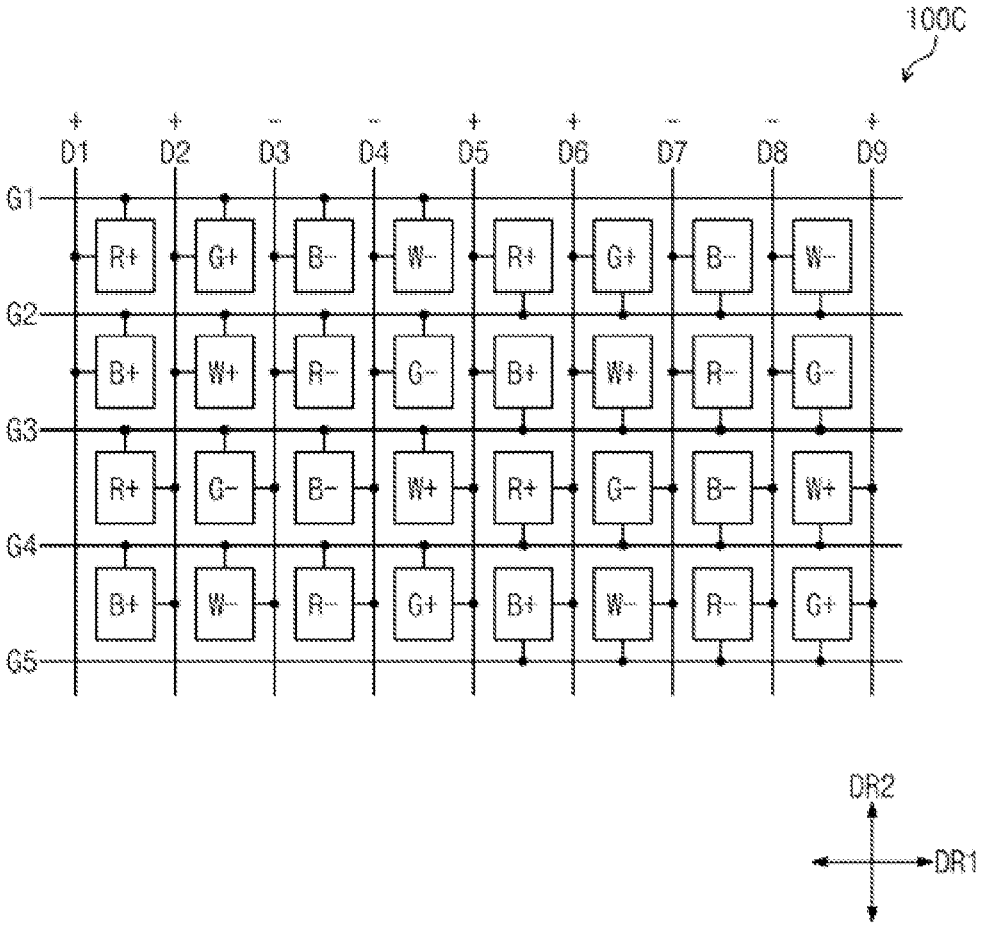
Figure 14:
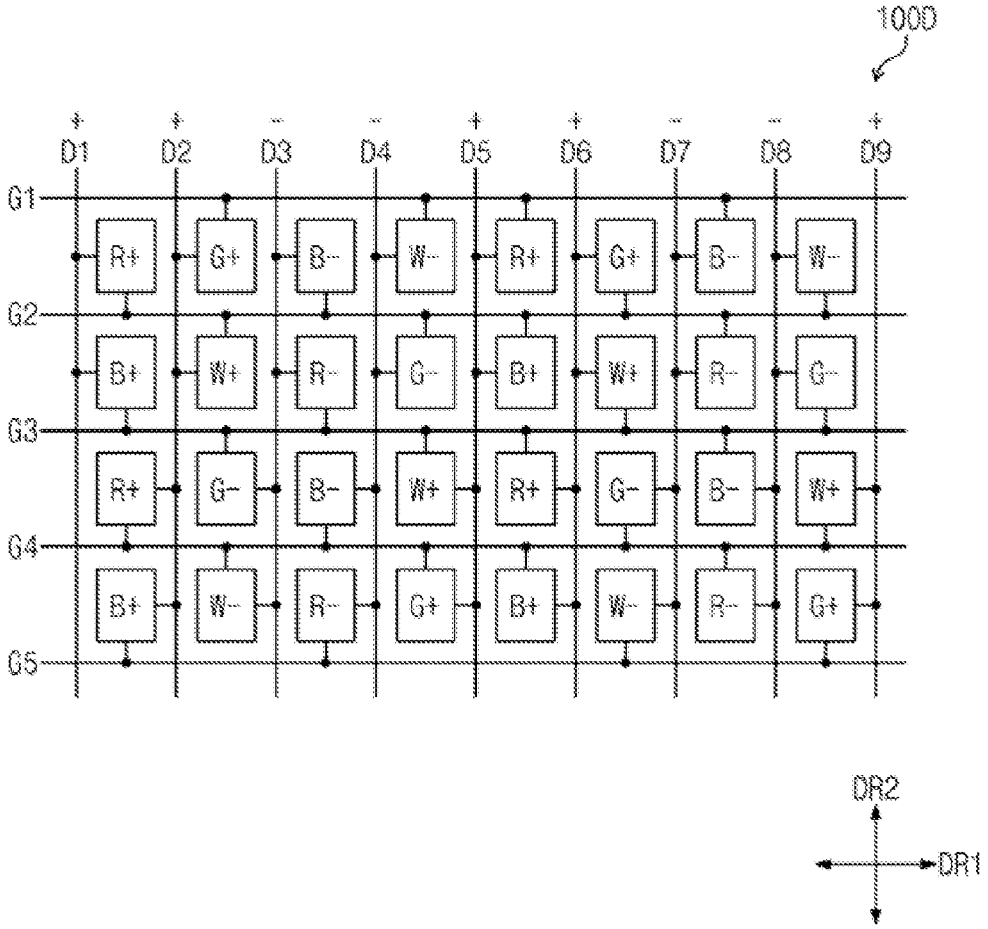
Figure 15:
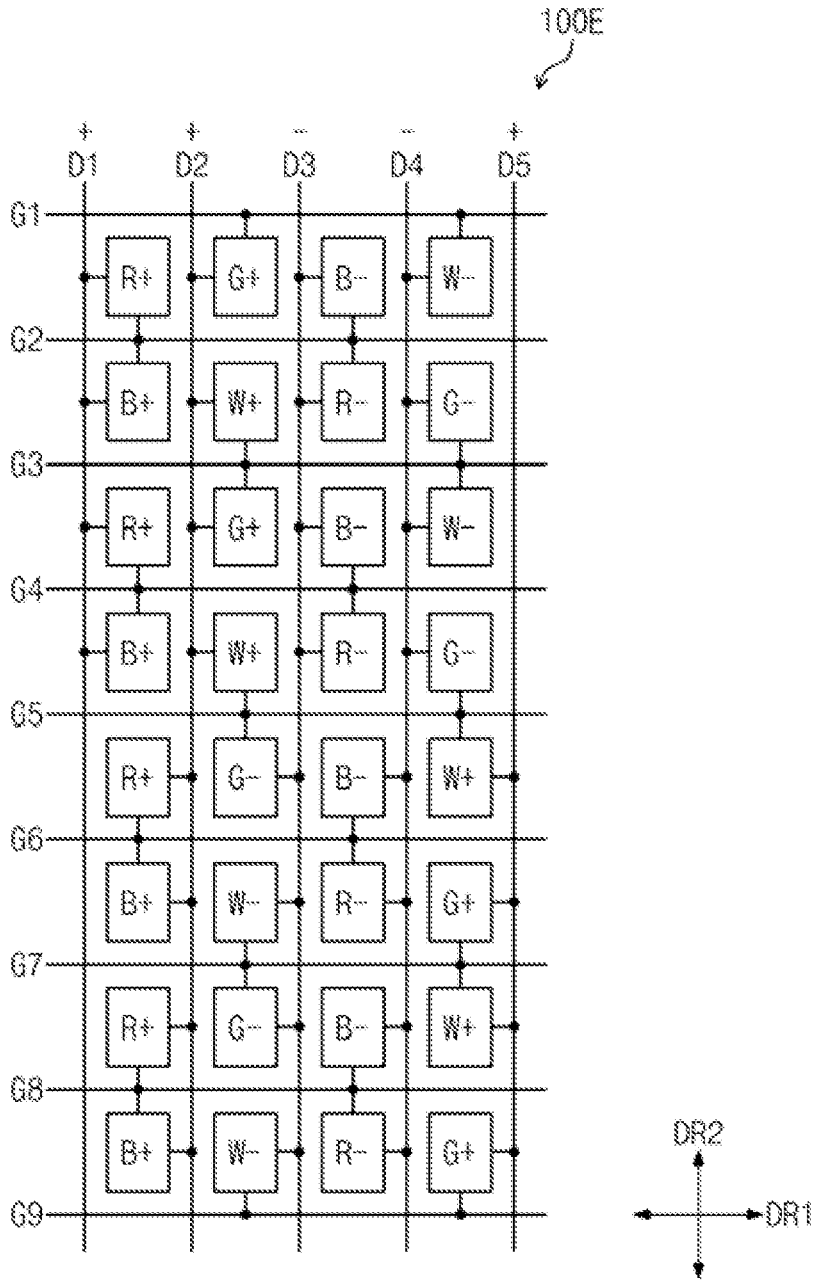
Figure 16:
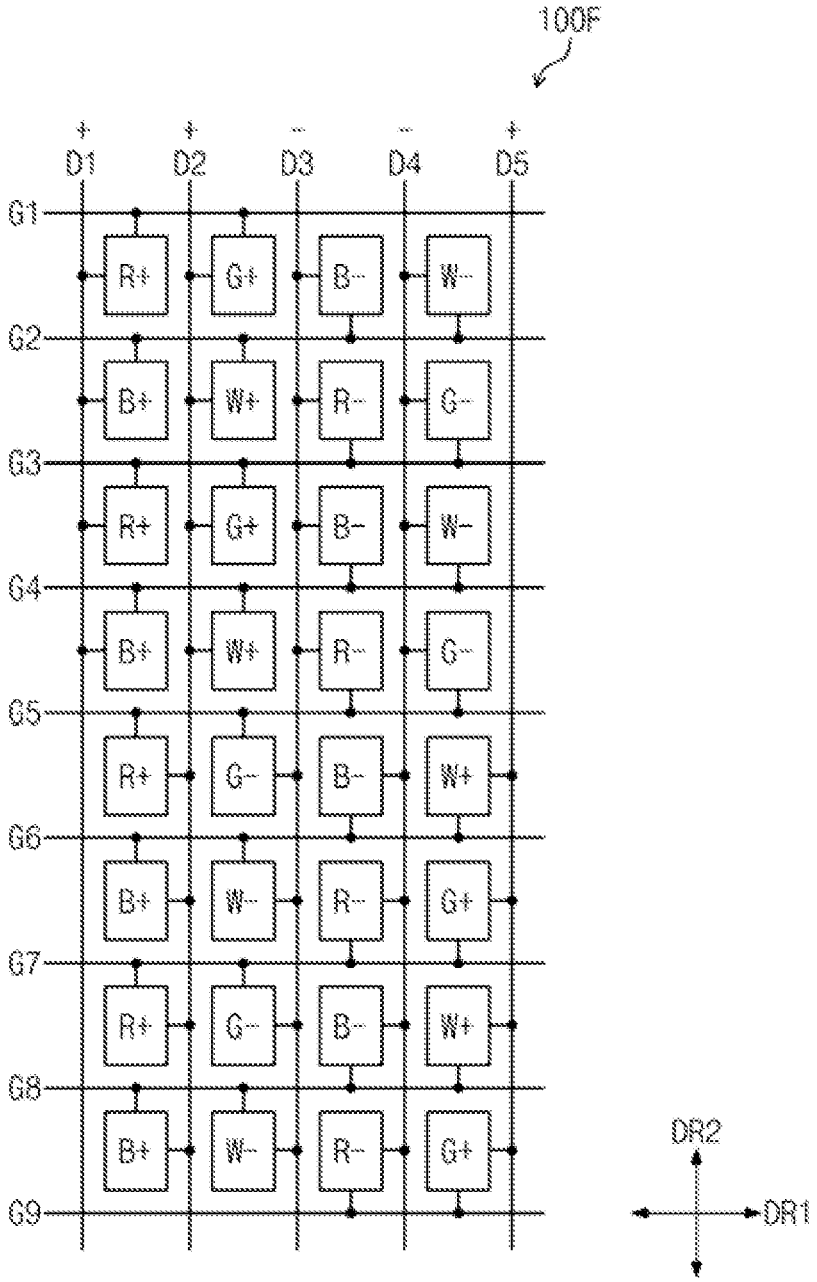
Figure 17:
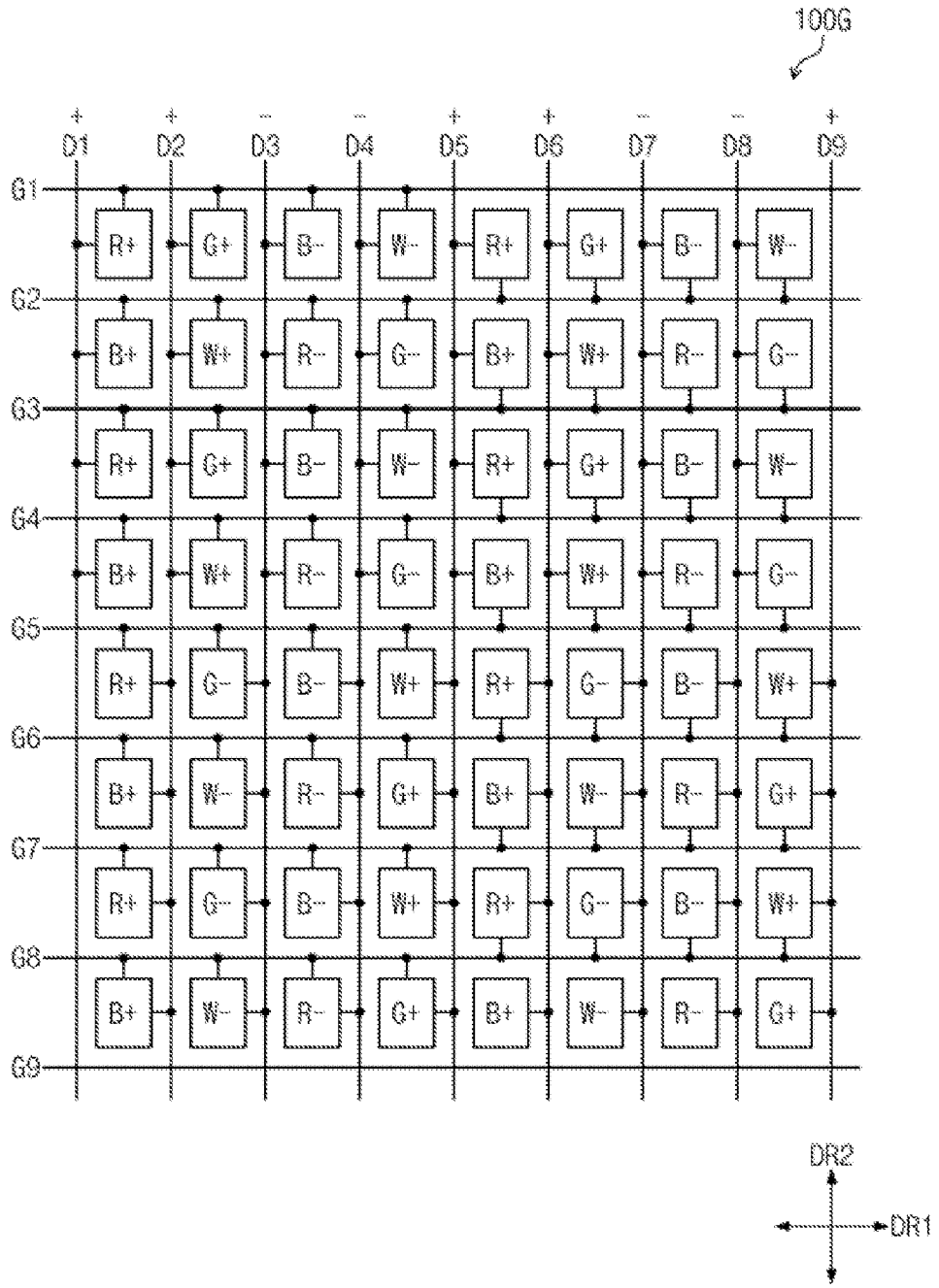
Figure 18:
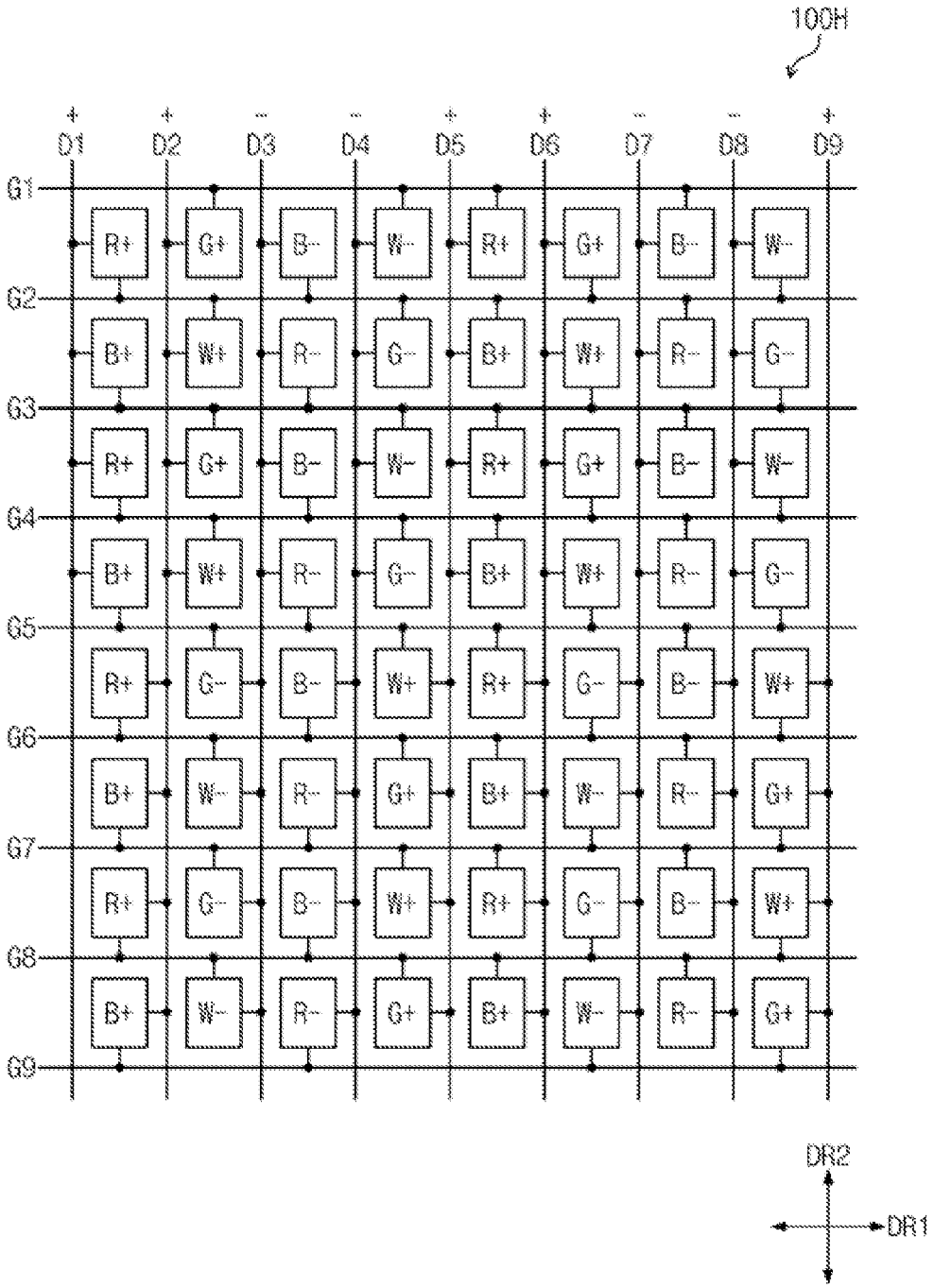

The liquid crystal panels 100B to 100D to FIGS. 12 to 14 differ, in common, from the liquid crystal panel in FIG. 3 in that pixels included in a row are alternately connected to data lines adjacent to each other. Referring to FIGS. 12 to 14, pixels in an h-th row disposed between a k-th gate line and a (k+1)-th gate line may be alternately connected to the k-th gate line and the (k+1)-th gate line by every at least one pixel.

Referring to FIG. 12, pixels in an h-th row disposed between a k-th gate line and a (k+1)-th gate line of the liquid crystal panel 100B may be alternately connected to the k-th gate line and the (k+1)-th gate line by every two pixels.

Referring to FIG. 13, pixels in an h-th row disposed between a k-th gate line and a (k+1)-th gate line of the liquid crystal panel 100D may be alternately connected to the k-th gate line and the (k+1)-th gate line by every four pixels.

Referring to FIG. 14, pixels in an h-th row disposed between a k-th gate line and a (k+1)-th gate line of the liquid crystal panel 100D may be inversely connected to the k-th gate line and the (k+1)-th gate line by every four pixels.

Each of the liquid crystal panels 100E to 100H in FIGS. 15 to 18 differ from each of the liquid crystal panels 100A to 100D in FIGS. 11 to 14 in that pixels included in a column are alternately connected to data lines adjacent to each other by every four dots, and the remainders are substantially the same.

Figure 19:
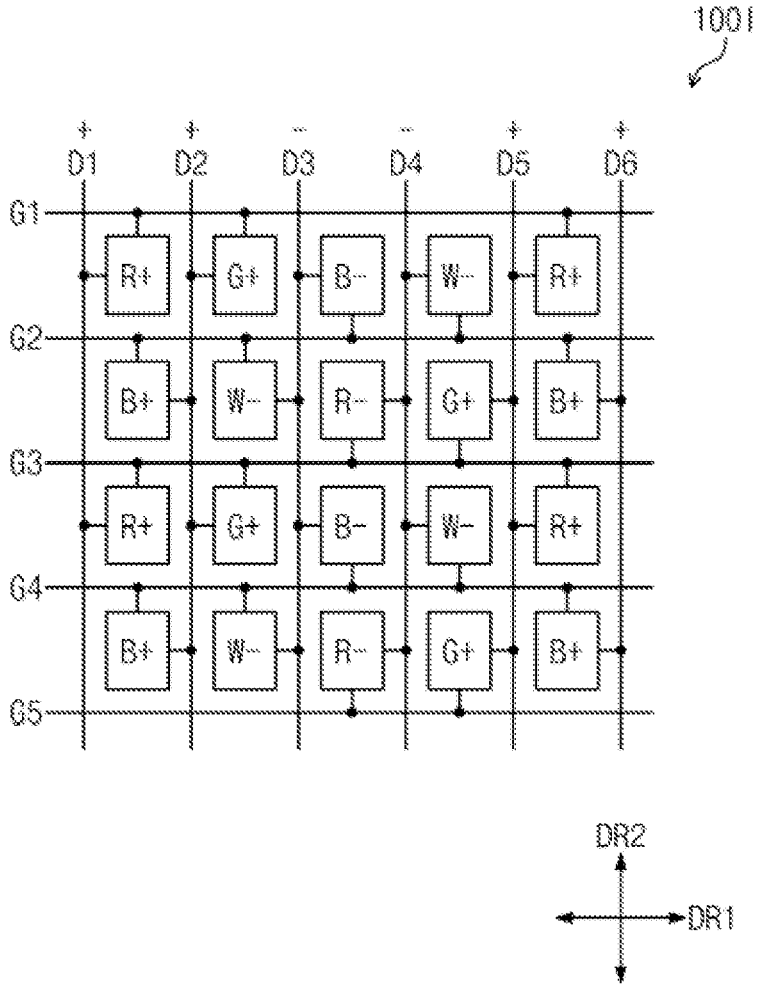
Figure 20:
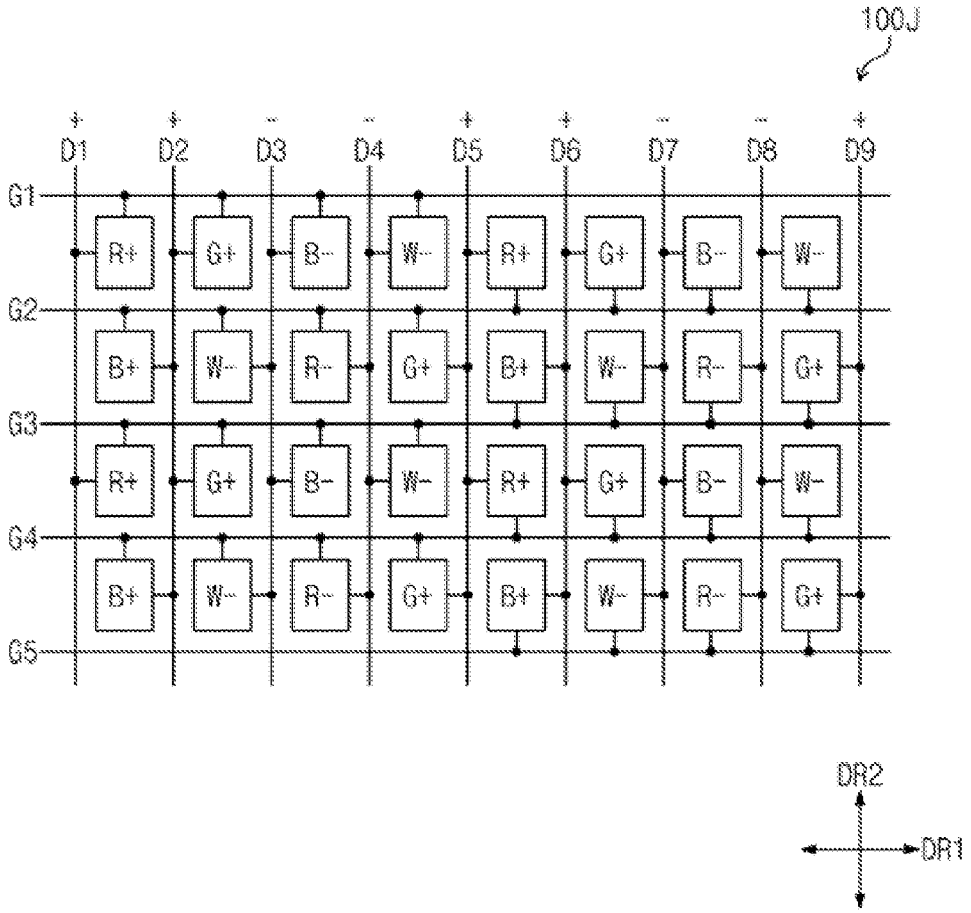
Figure 21:
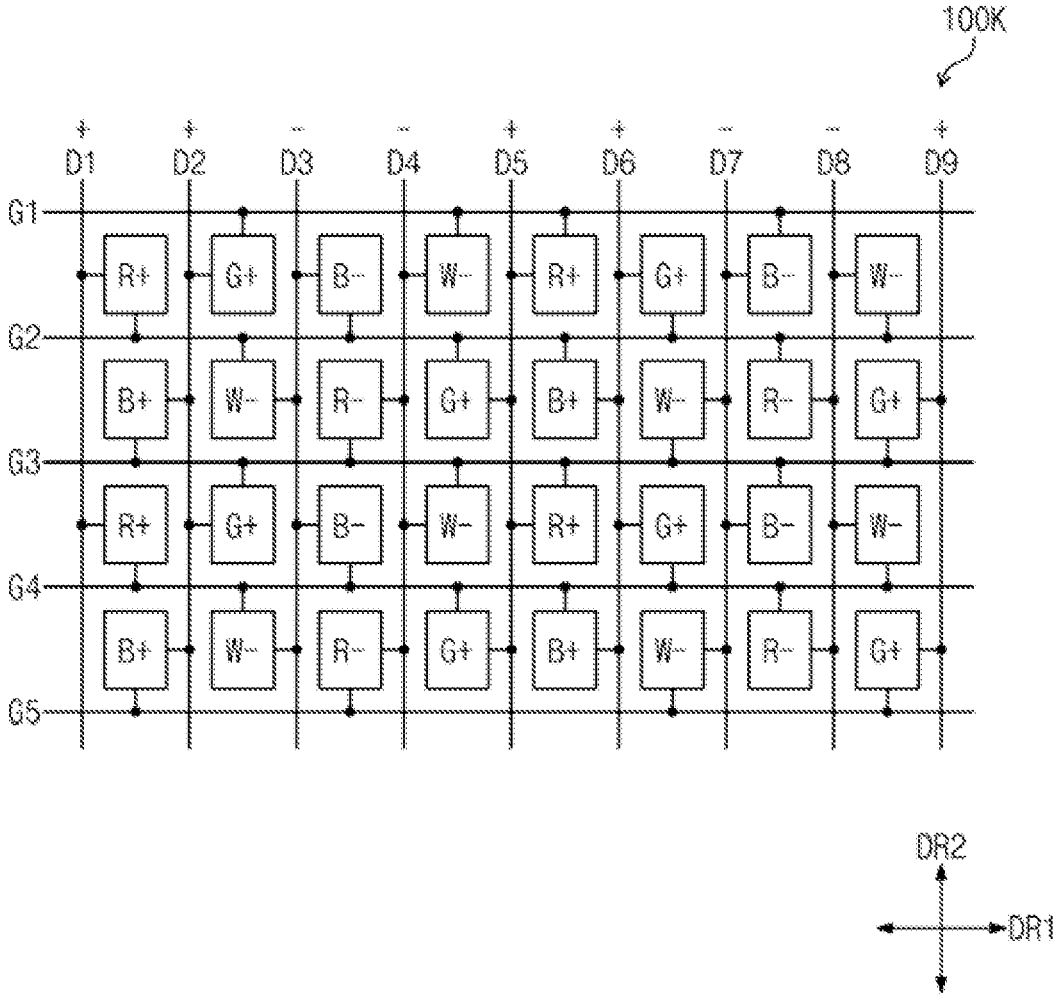

Each of the liquid crystal panels 100I to 100K in FIGS. 19 to 14 differ from each of the liquid crystal panels 100B to 100D in FIGS. 12 to 14 in that pixels included in a column are alternately connected to data lines adjacent to each other by every dot, and the remainders are substantially the same.

Each of the liquid crystal panels 100A to 100K in FIGS. 11 to 21 may prevent horizontal crosstalk and moving striped stains.

A display device and a driving method thereof according to the inventive concept may prevent single line crosstalk.

Although embodiments have been disclosed for illustrative purposes, those skilled in the art will appreciate that various modifications, additions and substitutions are possible, without departing from the scope and spirit of the inventive concept as disclosed in the accompanying claims. Accordingly, such modifications, additions and substitutions should also be understood to fall within the scope of the inventive concept.

What is claimed is:

1. A display device comprising:

a liquid crystal panel which includes a plurality of gate lines extending in a first direction, a plurality of data lines extending in a second direction intersecting with the first direction, a plurality of pixels connected to the gate lines and the data lines, and a common electrode, wherein the pixels includes pixels in an h-th (h is a natural number) row and pixels in an (h+1)-th row with a (k+1)-th (k is a natural number) gate line of the gate lines disposed therebetween, wherein the pixels in the h-th row and the pixels in the (h+1)-th row are adjacent to each other in the second direction, and first pixels which display a first color and are connected to the (k+1)-th gate line among the pixels in the h-th row, and second pixels which display the first color and are connected to the (k+1)-th gate line among the pixels in the (h+1)-th row, are spaced from each other in the first direction and receive data voltages having different polarities;

a gate driver configured to provide the gate lines with gate signals;

a data driver configured to provide the data lines with data voltages;

a timing controller which is configured to receive a control signal and image data, provide the gate driver with a gate control signal, and provide the data driver with a data control signal;

a common voltage generator configured to generate a common voltage to be applied to the common electrode; and a common voltage compensator which is configured to compensate the common voltage before a (k+1)-th gate signal is applied to the (k+1)-th gate line, in the case where a boundary of a pattern included in the image data, extending in the first direction, lies between the first pixels and the second pixels, wherein when the pattern is displayed in at least a portion of the first pixels and is not displayed in the second pixels, the common voltage compensator is configured to add a first compensating voltage having a polarity opposite to that of data voltages applied to the portion of the first pixels to the common voltage, wherein when the pattern is displayed in at least a portion of the second pixels and is not displayed in the first pixels, the common voltage compensator is configured to add a second compensating voltage having a polarity opposite to that of data voltages applied to the portion of the second pixels to the common voltage.

2. The display device of claim 1, wherein the common voltage compensator comprises:

a pattern analyzer which is configured to analyze the pattern included in the image data to determine whether the boundary of the pattern, extending in the first direction, lies between the first pixels and the second pixels;

a compensating section determiner which is configured to determine a compensating section in which the common voltage is to be compensated when the boundary of the pattern, extending in the first direction, lies between the first pixels and the second pixels; and a compensating voltage determiner which is configured to determine the magnitude and polarity of a compensating voltage to be compensated to the common voltage when the boundary of the pattern, extending in the first direction, lies between the first pixels and the second pixels.

3. The display device of claim 2, wherein the compensating section determiner is configured to set the compensating section to be within a horizontal blank section between a k-th horizontal scanning section in which a k-th gate signal is applied to a k-th gate line and a (k+1)-th horizontal scanning section in which the (k+1)-th gate signal is applied to the (k+1)-th gate line.

4. The display device of claim 3, wherein the compensating section determiner is configured to set the compensating section to be a section from a first point of time within the horizontal blank section to a point of time at which the (k+1)-th horizontal scanning section starts.

5. The display device of claim 4, wherein the first point of time is set to be a point of time at which data voltages are applied to the first pixels which display the pattern or a point of time at which data voltages are applied to the second pixels which display the pattern.

6. The display device of claim 2, wherein the compensating voltage determiner is configured to determine the magnitude of the compensating voltage, based on the number of pixels displaying the pattern among the first pixels and the second pixels and the level of data voltages applied to the pixels displaying the pattern.

7. The display device of claim 6, wherein when the pattern is displayed in at least a portion of the first pixels and is not displayed at the second pixels, the compensating voltage determiner is configured to set the polarity of the compensating voltage to be opposite to that of data voltages applied to the portion of the first pixels, wherein when the pattern is displayed in at least a portion of the second pixels and is not displayed at the first pixels, the compensating voltage determiner is configured to set the polarity of the compensating voltage to be opposite to that of data voltages applied to the portion of the second pixels.

8. The display device of claim 1, wherein the first color is any one of red, green, blue, or white.

9. The display device of claim 1, wherein the pixels in the h-th row comprise first and second pixel groups which are sequentially disposed in the first direction, and the pixels in the (h+1)-th row comprise third and fourth pixel groups which are sequentially disposed in the first direction, each of the first to fourth pixel groups comprising an even number of pixels.

10. The display device of claim 9, wherein each of the first and fourth pixel groups comprises two pixels among red, green, blue, and white pixels, each of the second and third pixel groups comprises the remaining two pixels among the red, green, blue, and white pixels.

11. The display device of claim 1, wherein the second pixels are included in pixels in a (2u+1)-th (u is a natural number) column when the first pixels are included in pixels in a (2u−1)-th column, and the second pixels are included in pixels in a (2u+2)-th column when the first pixels are included in pixels in a 2u-th column.

12. The display device of claim 1, wherein two pixels which are adjacent to each other in the second direction with a 2k-th gate line disposed therebetween, among pixels in a (2u−1)-th (u is a natural number) column, share the 2k-th gate line to be connected to each other, and two pixels which are adjacent to each other in the second direction with a (2k−1)-th gate line disposed therebetween, among pixels in a 2u-th column, share the (2k−1)-th gate line to be connected to each other.

13. The display device of claim 1, wherein two pixels which are adjacent to each other in the second direction with a (2k−1)-th gate line disposed therebetween, among pixels in a (2u−1)-th (u is a natural number) column, share the (2k−1)-th gate line to be connected to each other, and two pixels which are adjacent to each other in the second direction with a 2k-th gate line disposed therebetween, among pixels in a 2u-th column, share the 2k-th gate line to be connected to each other.

14. The display device of claim 1, wherein pixels in a u-th (u is a natural number) column, which are disposed between a j-th (j is a natural number) data line and a (j+1)-th data line of the data lines, are alternately connected to the j-th data line and the (j+1)-th data line by every at least one pixel.

15. The display device of claim 14, wherein the polarities of data voltages applied to the data lines are inversed by every at least one data line.

16. The display device of claim 14, wherein the pixels in the h-th row, which are disposed between a k-th gate line and the (k+1)-th gate line of the gate lines, are alternately connected to the k-th gate line and the (k+1)-th gate line by every at least one pixel.

17. A driving method of a display device, the driving method comprising:

providing a liquid crystal panel which includes a plurality of gate lines extending in a first direction, a plurality of data lines extending in a second direction intersecting with the first direction, a plurality of pixels connected to the gate lines and the data lines, and a common electrode, wherein the pixels includes pixels in an h-th (h is a natural number) row and pixels in an (h+1)-th row with a (k+1)-th (k is a natural number) gate line of the gate lines disposed therebetween, wherein the pixels in the h-th row and the pixels in the (h+1)-th row are adjacent to each other in the second direction, and first pixels which display a first color and are connected to the (k+1)-th gate line among the pixels in the h-th row, and second pixels which display the first color and are connected to the (k+1)-th gate line among the pixels in the (h+1)-th row, are spaced from each other in the first direction and receive data voltages having different polarities;

generating a common voltage to be applied to the common electrode;

determining whether a boundary of a pattern included in image data input, extending in the first direction, lies between the first pixels and the second pixels; and compensating the common voltage before a (k+1)-th gate signal is applied to the (k+1)-th gate line, in the case where the boundary of the pattern included in the image data, extending in the first direction, lies between the first pixels and the second pixels, wherein the compensating of the common voltage comprises:

determining the magnitude of a compensating voltage to be compensated to the common voltage;

determining the polarity of the compensating voltage; and determining a compensating section in which the common voltage is to be compensated.

18. The driving method of claim 17, wherein the compensating section is set to be within a horizontal blank section between a k-th horizontal scanning section in which a k-th gate signal is applied to a k-th gate line and a (k+1)-th horizontal scanning section in which the (k+1)-th gate signal is applied to the (k+1)-th gate line.

* * * * *